US012571152B2

(12) United States Patent
Lee et al.

(10) Patent No.: US 12,571,152 B2
(45) Date of Patent: Mar. 10, 2026

(54) WASHING MACHINE AND CONTROL METHOD THEREOF

(71) Applicant: SAMSUNG ELECTRONICS CO., LTD., Suwon-si (KR)

(72) Inventors: Sungmo Lee, Suwon-si (KR); Junhyun Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 393 days.

(21) Appl. No.: 17/889,104

(22) Filed: Aug. 16, 2022

(65) Prior Publication Data

US 2023/0119410 A1 Apr. 20, 2023

Related U.S. Application Data

(63) Continuation of application No. PCT/KR2022/010201, filed on Jul. 13, 2022.

(30) Foreign Application Priority Data

Oct. 18, 2021 (KR) ..... 10-2021-0138285

(51) Int. Cl.
*D06F 37/30* (2020.01)
*D06F 33/32* (2020.01)
(Continued)

(52) U.S. Cl.
CPC ..... *D06F 37/304* (2013.01); *D06F 33/32* (2020.02); *D06F 37/40* (2013.01);
(Continued)

(58) Field of Classification Search
CPC ..... D06F 37/30; D06F 37/40
See application file for complete search history.

(56) References Cited

U.S. PATENT DOCUMENTS 10,214,846 B2 2/2019 Song
10,954,621 B2 3/2021 Ueno et al.
(Continued)

FOREIGN PATENT DOCUMENTS

CN 1107758 C * 5/2003
EP 2 771 964 B1 2/2018
(Continued)

OTHER PUBLICATIONS

International Search Report dated Nov. 3, 2022 in International PatentApplication No. PCT/KR2022/010201 (3 pages; 4 pages English translation).
(Continued)

*Primary Examiner* — Omair Chaudhri
(74) *Attorney, Agent, or Firm* — STAAS & HALSEY LLP

(57) ABSTRACT

A washing machine includes a drum, a pulsator, a motor including a stator, a first rotor connected to the drum and second rotor connected to the pulsator, an inverter circuit connected to the motor, and at least one processor configured to control the inverter circuit to selectively drive the motor based on a plurality of driving modes, the plurality of driving modes including a first driving mode to rotate only the first rotor, a second driving mode to rotate only the second rotor, or a third driving mode to rotate both the first rotor and the second rotor, control the inverter circuit to stop both the first rotor and the second rotor in response to changing from one of the plurality of driving modes to an other one of the plurality of driving modes, and control the inverter circuit to drive the motor based on the changed driving mode.

20 Claims, 14 Drawing Sheets

(51) Int. Cl.

| | |
|---|---|
| ***D06F 37/40*** | (2006.01) |
| ***D06F 103/24*** | (2020.01) |
| ***D06F 103/46*** | (2020.01) |
| ***D06F 105/48*** | (2020.01) |

(52) U.S. Cl.
CPC ..... *D06F 2103/24* (2020.02); *D06F 2103/46* (2020.02); *D06F 2105/48* (2020.02)

(56) References Cited

U.S. PATENT DOCUMENTS

| | | | | |
|---|---|---|---|---|
| 2010/0327788 | A1* | 12/2010 | Laulanet | H02P 6/21 318/400.11 |
| 2012/0011659 | A1* | 1/2012 | Park | D06F 33/38 68/12.13 |
| 2013/0111676 | A1* | 5/2013 | Jun | H02K 11/215 8/137 |
| 2014/0091662 | A1* | 4/2014 | Kim | H02K 16/00 310/114 |
| 2015/0240404 | A1* | 8/2015 | Kim | D06F 37/30 68/12.14 |
| 2015/0252510 | A1* | 9/2015 | Heo | D06F 33/48 68/12.14 |
| 2016/0103739 | A1* | 4/2016 | Huang | G06F 11/1451 714/19 |
| 2016/0130739 | A1* | 5/2016 | Song | H02K 16/02 68/133 |
| 2016/0201241 | A1* | 7/2016 | Zhang | D06F 17/10 68/134 |
| 2016/0201246 | A1* | 7/2016 | Song | D06F 37/304 8/137 |
| 2017/0191203 | A1* | 7/2017 | Kim | D06F 37/30 |
| 2017/0204551 | A1* | 7/2017 | Kim | D06F 37/40 |
| 2017/0327990 | A1* | 11/2017 | Lee | D06F 37/42 |
| 2018/0030635 | A1* | 2/2018 | Park | D06F 37/40 |
| 2018/0038030 | A1* | 2/2018 | Jang | D06F 23/04 |
| 2019/0062976 | A1* | 2/2019 | Bae | D06F 33/32 |
| 2020/0040505 | A1* | 2/2020 | Jang | D06F 39/087 |
| 2020/0080246 | A1* | 3/2020 | Miyake | H02K 21/16 |
| 2020/0318279 | A1* | 10/2020 | Park | H02P 3/20 |
| 2021/0189623 | A1* | 6/2021 | Park | D06F 33/47 |
| 2023/0063914 | A1* | 3/2023 | Zhu | H02P 27/08 |

FOREIGN PATENT DOCUMENTS

| | | | |
|---|---|---|---|
| EP | 3 316 458 | A1 | 5/2018 |
| EP | 3 428 334 | A1 | 1/2019 |
| JP | 3496518 | A | 2/2004 |
| JP | 2016-168108 | | 9/2016 |
| JP | 2016-171625 | A | 9/2016 |
| KR | 10-2013-0044766 | | 5/2013 |
| KR | 10-1448914 | | 10/2014 |
| KR | 10-1619231 | | 5/2016 |
| KR | 10-2017-0012016 | A | 2/2017 |
| KR | 10-1939204 | | 1/2019 |
| KR | 10-2019-0024586 | A | 3/2019 |
| KR | 10-1951423 | | 4/2019 |
| KR | 10-2019-0074944 | | 6/2019 |
| KR | 10-2019-0104718 | | 9/2019 |
| KR | 20190104719 | A * | 9/2019 |

OTHER PUBLICATIONS

PCT/ISA/237 dated Nov. 3, 2022 in International Patent Application No. PCT/KR2022/010201 (5 pages).

Supplementary European Search Report dated Sep. 25, 2024 issued in European Application No. EP 22 88 3721.

* cited by examiner

WASHING MACHINE AND CONTROL METHOD THEREOF

CROSS-REFERENCE TO RELATED APPLICATION(S)

This application is a continuation application, under 35 U.S.C. § 111 (a), of international application No. PCT/KR2022/010201, filed on Jul. 13, 2022, which claims priority to Korean Patent Application No. 10-2021-0138285, filed on Oct. 18, 2021, in the Korean Intellectual Property Office, the disclosure of which is incorporated by reference herein in its entirety

BACKGROUND

1. Field

The disclosure relates to a washing machine and a control method thereof, and more particularly, to a washing machine including a motor including a dual rotor, and a control method thereof.

2. Description of Related Art

Generally, a washing machine includes a plurality of motors. For example, the plurality of motors including a motor for a drum for rotating the drum and a motor for a pulsator for rotating the pulsator, respectively.

Recently, in order to reduce the cost caused by having a plurality of motors, a motor provided with a dual rotor may be used.

However, when controlling a motor composed of a dual rotor, the stability may be deteriorated and the abnormal noise may occur.

SUMMARY

Therefore, it is an aspect of the disclosure to provide a washing machine capable of synchronizing a timing of a pulse width modulation (PWM) control upon controlling a motor provided with a dual rotor, thereby improving a driving stability of the motor and reducing generation of abnormal noise, and a control method thereof.

Additional aspects of the disclosure will be set forth in part in the description which follows and, in part, will be obvious from the description, or may be learned by practice of the disclosure.

In accordance with an aspect of the disclosure, a washing machine includes a drum, a pulsator, a motor including a stator, a first rotor connected to the drum and a second rotor connected to the pulsator, an inverter circuit connected to the motor, and at least one processor configured to control the inverter circuit to selectively drive the motor based on a plurality of driving modes, the plurality of driving modes including a first driving mode to rotate only the first rotor, a second driving mode to rotate only the second rotor, and a third driving mode to rotate the first rotor and the second rotor. The at least one processor is configured to control the inverter circuit to stop both the first rotor and the second rotor in response to changing from one of the plurality of driving modes to an other one of the plurality of driving modes and control the inverter circuit to drive the motor based on the changed driving mode.

The at least one processor may be further configured to control the inverter circuit to stop the first rotor in response to the changing of the driving mode of the motor from the first driving mode to the third driving mode.

The at least one processor may be further configured to control the inverter circuit to stop the second rotor in response to the changing of the driving mode of the motor from the second driving mode to the third driving mode.

The at least one processor may be further configured to control the inverter circuit to stop both the first rotor and the second rotor in response to the changing of the driving mode of the motor from the third driving mode to the first driving mode or the second driving mode.

The at least one processor may be further configured to control the inverter circuit to stop the first rotor in response to the changing of the driving mode of the motor from the first driving mode to the second driving mode, and the at least one processor may be further configured to control the inverter circuit to start a driving operation of the second driving mode to rotate the second rotor only in response to the stopping of the first rotor.

The at least one processor may be further configured to control the inverter circuit to stop the second rotor in response to the changing of the driving mode of the motor from the second driving mode to the first driving mode, and the at least one processor may be configured to control the inverter circuit to start a driving operation of the first driving mode to rotate the first rotor only in response to the stopping of the second rotor.

The at least one processor may be further configured to perform a pulse width modulation (PWM) control on both the first inverter and the second inverter in the first driving mode or in the second driving mode.

The at least one processor may be further configured to output a signal for changing a voltage command value for controlling the second rotor in the first driving mode, to 0 (zero) regardless of a speed command value or a current command value, and configured to output a signal for changing a voltage command value for controlling the first rotor in the second driving mode, to 0 (zero) regardless of a speed command value or a current command value.

The at least one processor may be further configured to control the inverter circuit to start a driving operation of the first driving mode to rotate the first rotor only or the second rotor only in response to the stopping of both the first rotor and the second rotor.

The inverter circuit may include a plurality of upper switching elements and a plurality of lower switching elements to control the driving of the motor.

The driving operation may include a bootstrap operation to turn off the plurality of upper switching elements and turn on the plurality of lower switching elements, an offset correction operation to compare a voltage value at both ends of a shunt resistor included in the inverter circuit with a reference voltage value, an alignment operation to align the first rotor and the second rotor to a predetermined angle, a rotation operation to rotate at least one of the first rotor and the second rotor at a reference speed, and a speed control operation to rotate at least one of the first rotor and the second rotor at a target speed.

The at least one processor may be further configured to simultaneously start the PWM control on the first inverter and the second inverter based on the completion of the offset correction operation.

The at least one processor may be further configured to control the inverter circuit to such that an operation ratio of the first rotor and an operation ratio of the second rotor are equal to each other.

The at least one processor may be further configured to stop driving the first inverter and the second inverter in response to an overcurrent signal being output from one of the first inverter or the second inverter.

The at least one processor may be further configured to control the inverter circuit to supply a six-phase current to the motor in the first driving mode, configured to control the inverter circuit to supply a three-phase current to the motor in the second driving mode, and configured to control the inverter circuit to supply a combined current, in which the three-phase current and the six-phase current are combined, to the motor in the third driving mode.

The at least one processor may be further configured to control the inverter circuit such that the motor is driven in the third driving mode in a washing process, and configured to control the inverter circuit such that the motor is driven in the first driving mode in a rinsing process.

The first rotor may be arranged outside the stator and the second rotor may be arranged inside the stator.

The at least one processor is further configured to control the inverter circuit to start a driving operation of the third driving mode to rotate both the first rotor and the second rotator in response to the stopping of the first rotor.

The at least one processor is further configured to control the inverter circuit to start a driving operation of the third driving mode to rotate both the first rotor and the second rotator in response to the stopping of the second rotor.

In accordance with another aspect of the disclosure, a control method of a washing machine including a motor including a stator, a first rotor connected to a drum and a second rotor connected to a pulsator, the control method includes selectively driving the motor based on a plurality of driving modes to operate the washing machine, in the plurality of driving modes including a first driving mode to rotate the first rotor only, a second driving mode to rotate the second rotor only, and a third driving mode to rotate both the first rotor and the second rotor, stopping both the first rotor and the second rotor in response to changing from one of the plurality of driving modes to an other one of the plurality of driving mode; and performing a driving operation of the changed mode by driving the motor in the changed mode.

The stopping of both the first rotor and the second rotor may include stopping the first rotor or the second rotor in response to the changing of the driving mode of the motor from the first driving mode or the second driving mode to the third driving mode.

The stopping of both the first rotor and the second rotor may include stopping both the first rotor and the second rotor in response to the driving mode of the motor being changed from the third driving mode to the first driving mode or the second driving mode.

The control method may further include rotating one or more of the first rotor and the second rotor in response to the stopping of both the first rotor and the second rotor.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
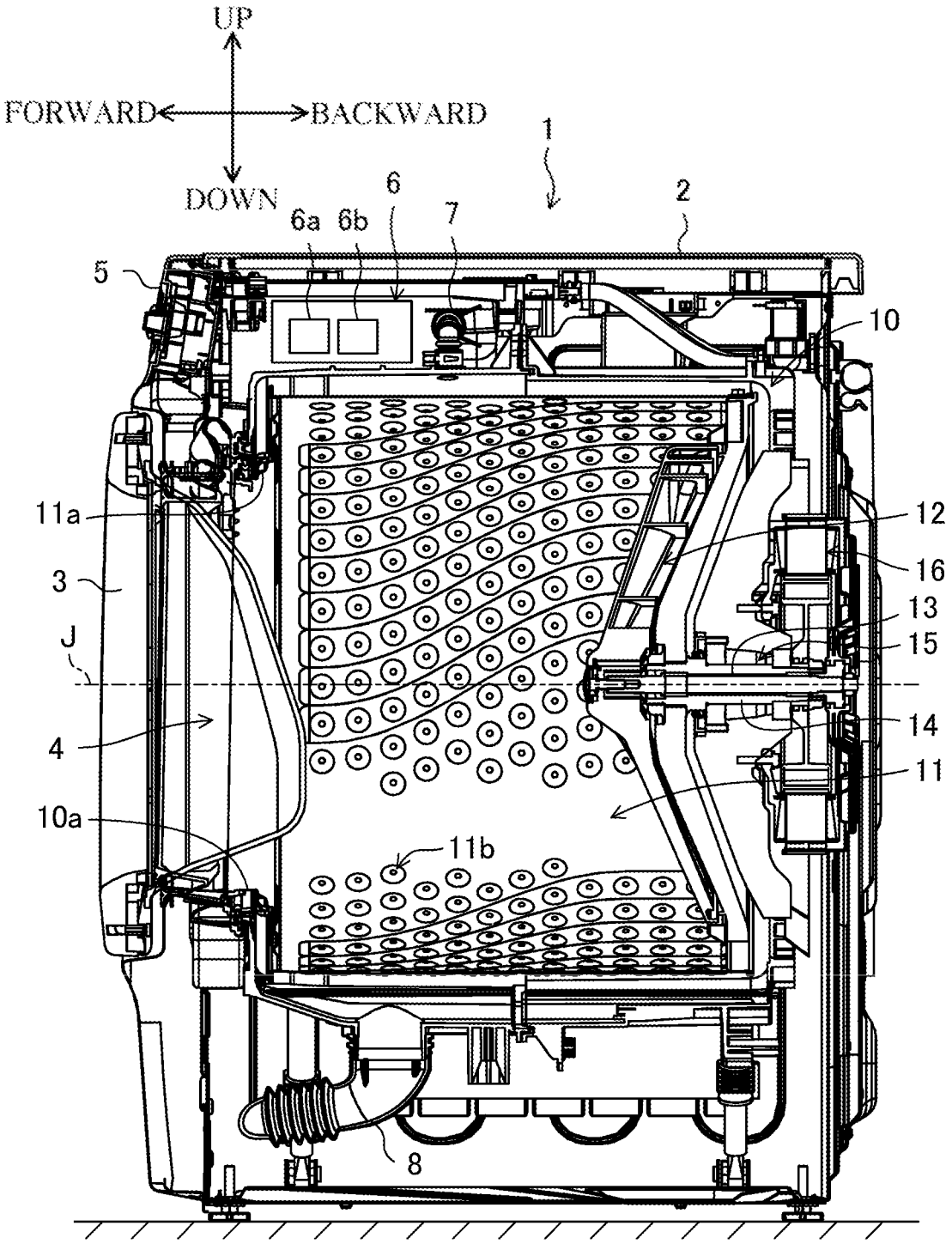
FIG. 1 is a side cross-sectional view illustrating a washing machine according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

The terms used herein are used to describe the embodiments and are not intended to limit and/or restrict the disclosure.

The singular forms “a,” “an” and “the” are intended to include the plural forms as well, unless the context clearly indicates otherwise.

In this disclosure, the terms “including”, “having”, and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms.

In the following description, terms such as “unit”, “part”, “block”, “member”, and “module” indicate a unit for processing at least one function or operation. For example, those terms may refer to at least one process processed by at least one hardware such as Field Programmable Gate Array (FPGA), Application Specific Integrated Circuit (ASIC), at least one software stored in a memory or a processor.

In addition, the same reference numerals or signs shown in the drawings of the disclosure indicate elements or components performing substantially the same function.

The disclosure will be described more fully hereinafter with reference to the accompanying drawings.

FIG. 1 is a side cross-sectional view illustrating a washing machine according to an embodiment of the disclosure.

Referring to FIG. 1, a washing machine 1 may be a fully automatic washing machine configured to perform each process of washing, rinsing, and spin-drying by an automatic control.

The washing machine 1 may include a housing 2 in the form of a rectangular box, and a circular inlet 4 provided to be opened or closed by a door 3 may be formed on a front surface of the housing 2. Laundry may be taken in and out through the inlet 4.

A control panel 5 on which a switch, a touch pad, and a button are arranged may be installed on an upper portion of the front surface of the housing 2.

A controller 6, a water tub 10, a drum 11, a motor 16, and a pulsator 12 may be arranged in the housing 2.

The water tub 10 may be a cylindrical container including a bottom arranged on end of the water tub 10 and including an opening 10*a* having a smaller diameter than an inner diameter of the water tub 10. The water tub 10 may be installed inside the housing 2 in a state in which the water tub 10 is horizontally arranged to allow the opening 10*a* to face the circular inlet 4 and to allow a center line of the opening 10*a* to extend in an approximately horizontal direction. A water supplier 7 is provided above the water tub 10, and at the time of washing or rinsing, washing water and rinsing water supplied from the water supplier 7 are stored in a lower portion of the water tub 10. A drain pipe 8 provided to be opened and closed by a valve may be connected to a lower side of the water tub 10, and unnecessary water may be drained to the outside of the washing machine 1 through the drain pipe 8.

The drum 11 is a bottomed cylindrical container in which an opening 11*a* is provided on at one end thereof and a bottom is provided on the other end thereof. The drum 11 is accommodated the water tub 10 in a state in which the opening 11*a* faces the front side. The drum 11 is rotatable about a rotation axis J extending in the front and rear direction, and each process such as washing, rinsing, and spin-drying is performed in a state in which laundry is accommodated in the drum 11.

A plurality of water passage holes 11*b* penetrating inside and outside may be formed on a wall of the drum 11. The washing water stored in the water tub 10 may be introduced into the drum 11 through the water passage hole 11*b*.

The pulsator 12 may be arranged at the bottom of the drum 11. The pulsator 12 may rotate with respect to the rotation axis J, independently of the drum 11.

A dual shaft 15 composed of an inner shaft 13 and an outer shaft 14 may be installed by penetrating the bottom of the water tub 10 with respect to the rotation axis J. The outer shaft 14 may be a cylindrical shaft having an axial length less than that of the inner shaft 13.

The inner shaft 13 may be pivotally supported on the inside of the outer shaft 14, and the pulsator 12 may be connected to a tip end of the inner shaft 13 so as to be supported. The outer shaft 14 may be pivotally supported on the water tub 10, and the drum 11 may be connected to a tip end of the outer shaft 14 so as to be supported. A base member of the outer shaft 14 and the inner shaft 13 may be connected to a motor 16 arranged on the rear side of the water tub 10.

The motor 16 may include a flat cylindrical appearance having a diameter smaller than that of the water tub 10, and may be attached to the rear side of the water tub 10. The motor 16 may drive the outer shaft 14 and the inner shaft 13 independently of each other.

The controller 6 may be provided with hardware such as a CPU and memory, and software such as a control program. The controller 6 may include at least one memory 6*a* configured to store data in the form of an algorithm and a program for controlling operation of components in the washing machine 1, and at least one processor 6*b* configured to perform the above-mentioned operation by using the data stored in the at least one memory. The memory 6*a* and the processor 6*b* may be implemented as separate chips. Alternatively, the memory 6*a* and the processor 6*b* may be implemented as a single chip.

The controller 6 may control various components (for example, the motor 16) of the washing machine 1, and the controller 6 may automatically drive the process of water supplying, washing, rinsing, and spin-drying according to an instruction input through the control panel 5.

Figure 2:
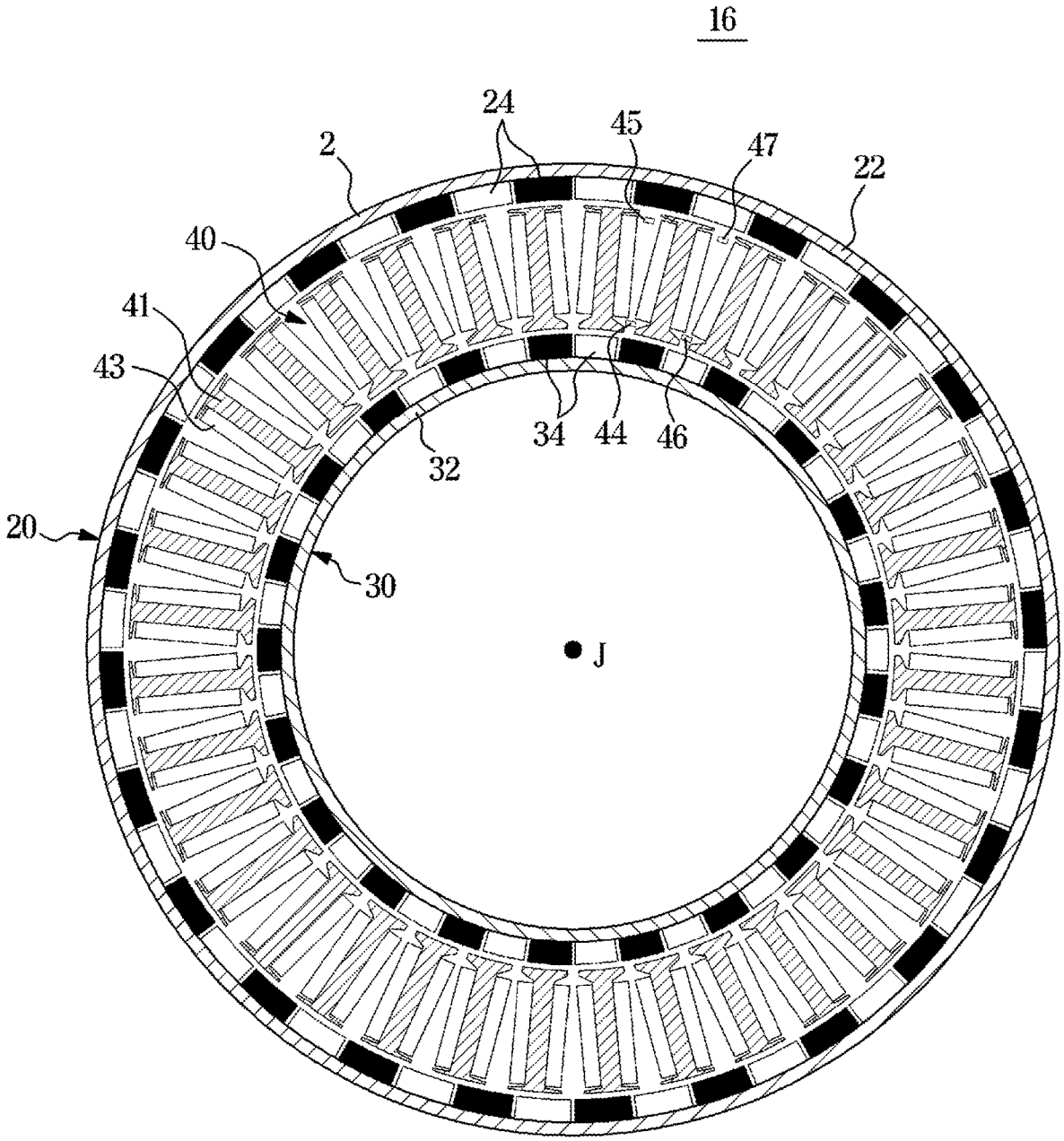
FIG. 2 is a view illustrating a motor of the washing machine according to an embodiment of the disclosure.

FIG. 2 is a view illustrating a motor of the washing machine according to an embodiment of the disclosure.

Referring to FIG. 2, the motor 16 may include a first rotor 20 (outer rotor), a second rotor 30 (inner rotor), and a stator 40. In an embodiment, the motor 16 may be a dual rotor motor 16 provided with an outer rotor 20 arranged in an outer side in a radial direction of a single stator 40, and an inner rotor 30 arranged in an inner side in the radial direction of the stator 40.

According to an embodiment, the outer rotor 20 and the inner rotor 30 may be connected to the drum 11 and the pulsator 12, respectively, and may directly drive the drum 11 and the pulsator 12, respectively.

According to various embodiments, the outer rotor 20 may be connected to the drum 11 and the inner rotor 30 may be connected to the pulsator 12.

The outer rotor 20 and the inner rotor 30 may share a coil 43 of the stator 40, and the motor 16 may drive the outer rotor 20 and the inner rotor 30 independently of each other by receiving a current (for example, three-phase current, six-phase current, combined current) through the coil 43.

According to an embodiment, the outer rotor 20 may be arranged outside the stator, and the inner rotor 30 may be arranged inside the stator 40.

The outer rotor 20 may be a cylindrical member with a flat bottom, and may include a rotor yoke 22 erected on a periphery of the bottom, and a plurality of outer magnets 24 formed with permanent magnets in the form of an arc.

According to various embodiments, forty-eight outer magnets 24 may be arranged such that N poles and S poles are alternately arranged in succession in an circumferential direction, and may be fixed to an inner surface of the rotor yoke 22.

The inner rotor 30 may be a cylindrical member with a flat bottom having an outer diameter less than that of the outer rotor 20, and include an inner peripheral wall 32 erected around the bottom and a plurality of inner magnets 34 formed with a permanent magnet in the form of a rectangular plate.

According to various embodiments, forty-two inner magnets 34 may be arranged such that N poles and S poles are alternately arranged in succession in the circumferential direction, and may be installed and fixed to an outer surface of the inner peripheral wall 32.

The stator 40 may be formed of an annular member including an outer diameter less than the inner diameter of the outer rotor 20 and greater than the outer diameter of the inner rotor 30. The stator 40 may be provided in a state in which a plurality of teeth 41 or the coils 43 are embedded with resin. According to various embodiments, the stator 40 may be provided with thirty-six teeth 41 in "I" shape and the coil 43.

The teeth 41 may be a thin plate-shaped iron member having an I-shape in a longitudinal section, and may be arranged on the entire circumference of the stator 40 to be radially arranged at equal intervals. An end of the inner and outer peripheral side of the teeth 41 may protrude in a flange shape from both corners of the tooth 41 in the circumferential direction.

A plurality of wires (for example, six wires) covered with an insulating material may be continuously wound around the teeth 41 in a predetermined sequence and configuration, and thus the coil 43 may be formed on each of the teeth 41. A group of the teeth 41, on which the coil 43 is formed, may be embedded with a thermosetting resin by molding in a state in which only an end surface of each diameter side is exposed, and the teeth 41 may be insulated and fixed in a predetermined arrangement.

According to various embodiments, the coil 43 may be formed by winding each of the six wires around each of the thirty-six teeth 41, which is in "I" shape, in a predetermined sequence.

The stator 40, the inner rotor 30, and the outer rotor 20 are attached such that an end, which is adjacent to the inner rotor 30, of the teeth 41 faces the inner magnet 34 with a slight gap and an end, which is adjacent to the outer rotor 20, of the teeth 41 faces the outer magnet 24 with a slight gap.

A digital magnetic flux sensor 44 or a speed sensor 46 may be arranged at a position in the vicinity of the inner rotor 30 between the adjacent teeth 41. The magnetic flux sensor 44 may be provided with a Hall sensor and configured to detect a position of the inner magnet 34 of the inner rotor 30. In addition, the speed sensor 46 may detect a rotation speed of the inner rotor 30.

Further, an analog magnetic flux sensor 45 and a speed sensor 47 may be arranged at a position in the vicinity of the outer rotor 20 between the adjacent teeth 41. The magnetic flux sensor 45 may be provided with a Hall sensor and configured to detect a position of the outer magnet 24 of the outer rotor 20. In addition, the speed sensor 47 may detect a rotation speed of the outer rotor 20.

According to an embodiment, a combined current composed of a three-phase current and a six-phase current may be supplied to the coil 43 of the stator 40, and the inner rotor 30 with a small number of poles may be designed to be driven in the three-phase current, and the outer rotor 20 with a large number of poles may be designed to be driven in the six-phase current.

According to various embodiments, the number of the outer magnets 24, the number of the inner magnets 34, or the number of the teeth 41 may be changed without limitation so as to allow the inner rotor 30 to be driven with the three-phase current and to allow the outer rotor 20 to be driven with the six-phase current. Particularly, according to an embodiment, the motor 16 may be provided in such a way that the number of slots S of the stator 60 is thirty six, the number of poles P1 of the inner rotor 30 is forty two, and the number of poles P2 of the outer rotor 20 is forty eight, and thus a ratio of S:P1:P2 is designed to be 6:7:8.

As described above, the inner rotor 30 may be connected to the inner shaft 13, and accordingly, may be connected to the pulsator 12.

The outer rotor 20 may be connected to the outer shaft 14, and accordingly, may be connected to the drum 11.

Figure 3:
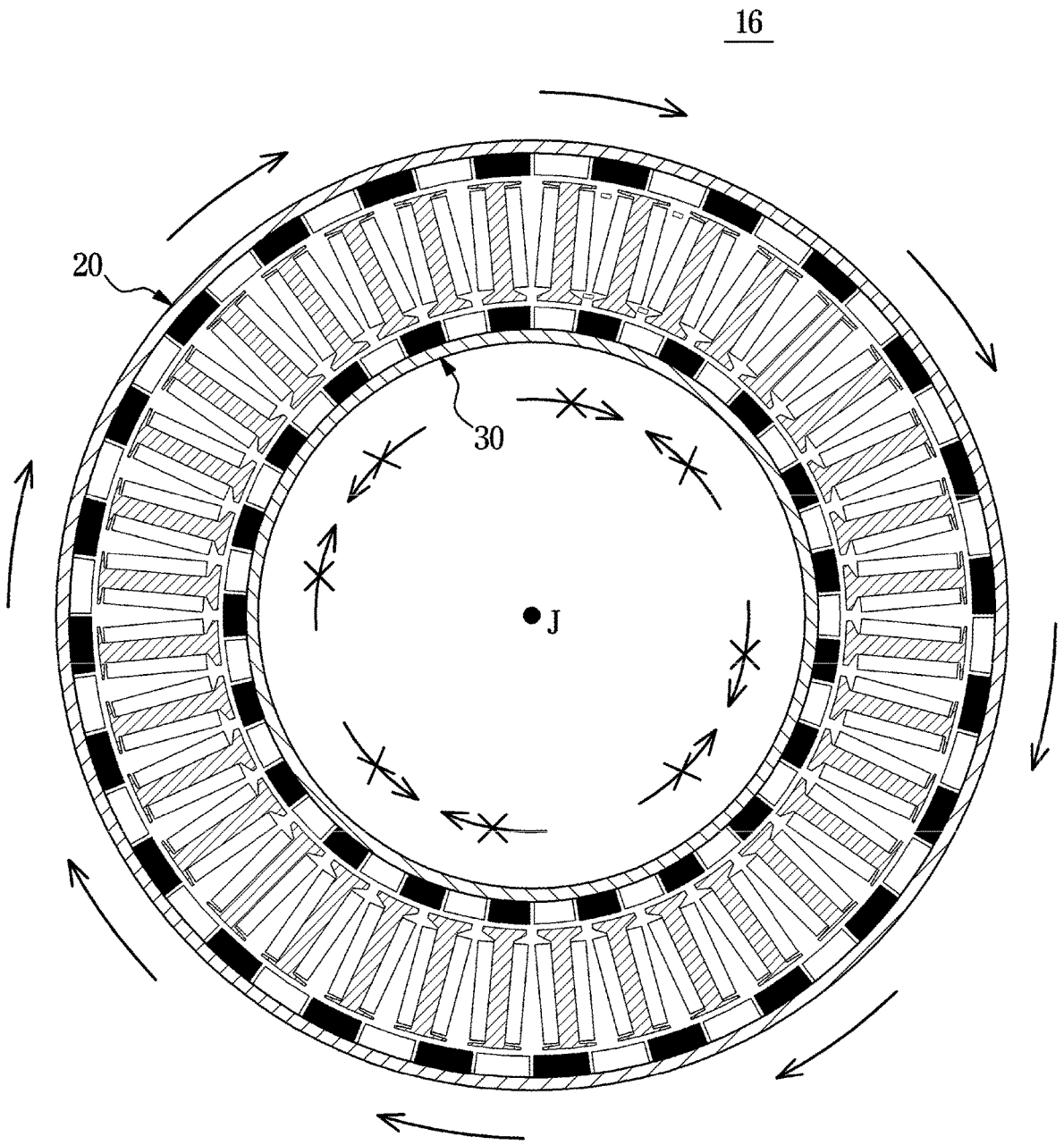
FIG. 3 is a view illustrating a state in which the motor of the washing machine according to an embodiment of the disclosure is driven in a first driving mode.
Figure 4:
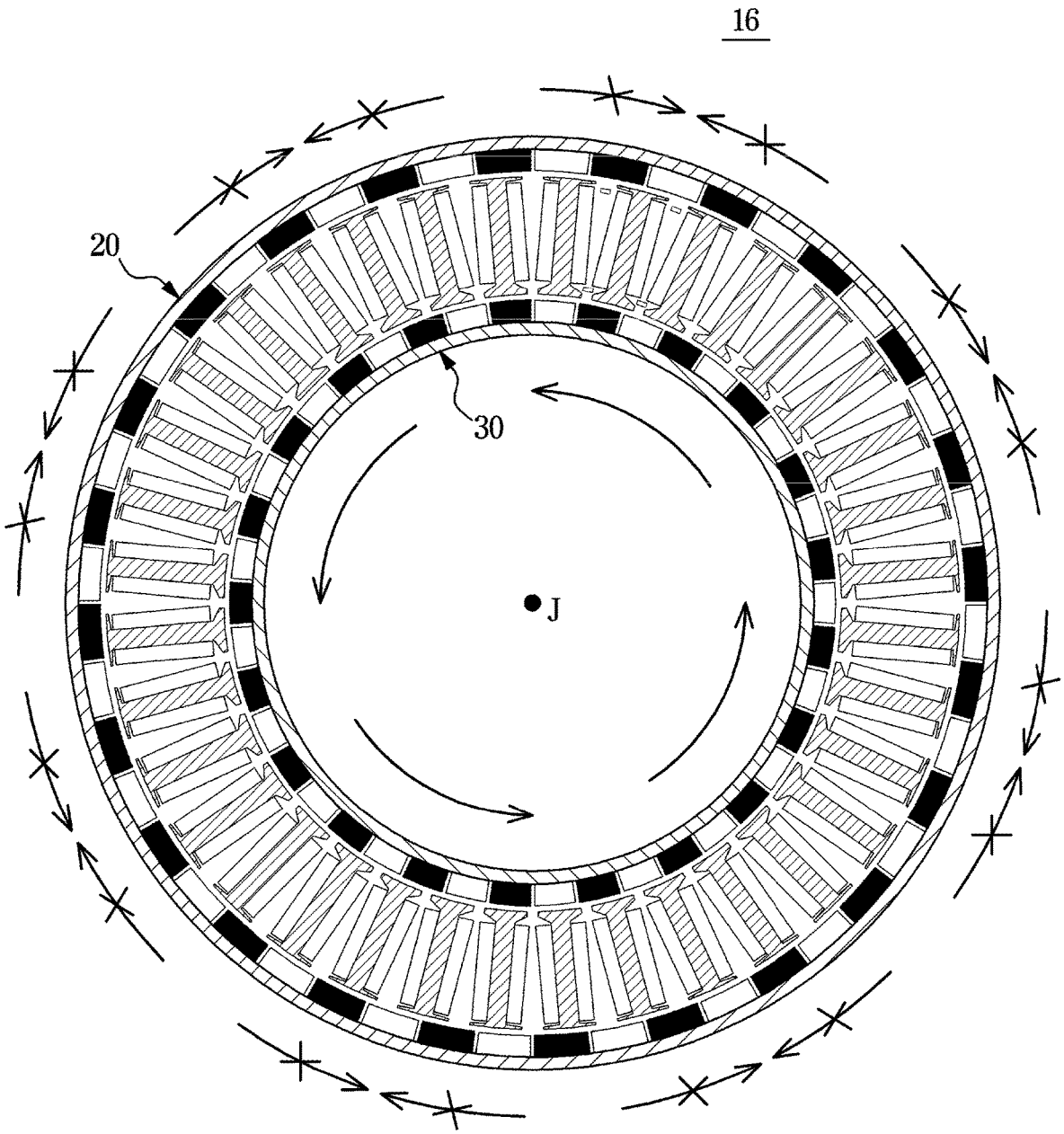
FIG. 4 is a view illustrating a state in which the motor of the washing machine according to an embodiment of the disclosure is driven in a second driving mode.
Figure 5:
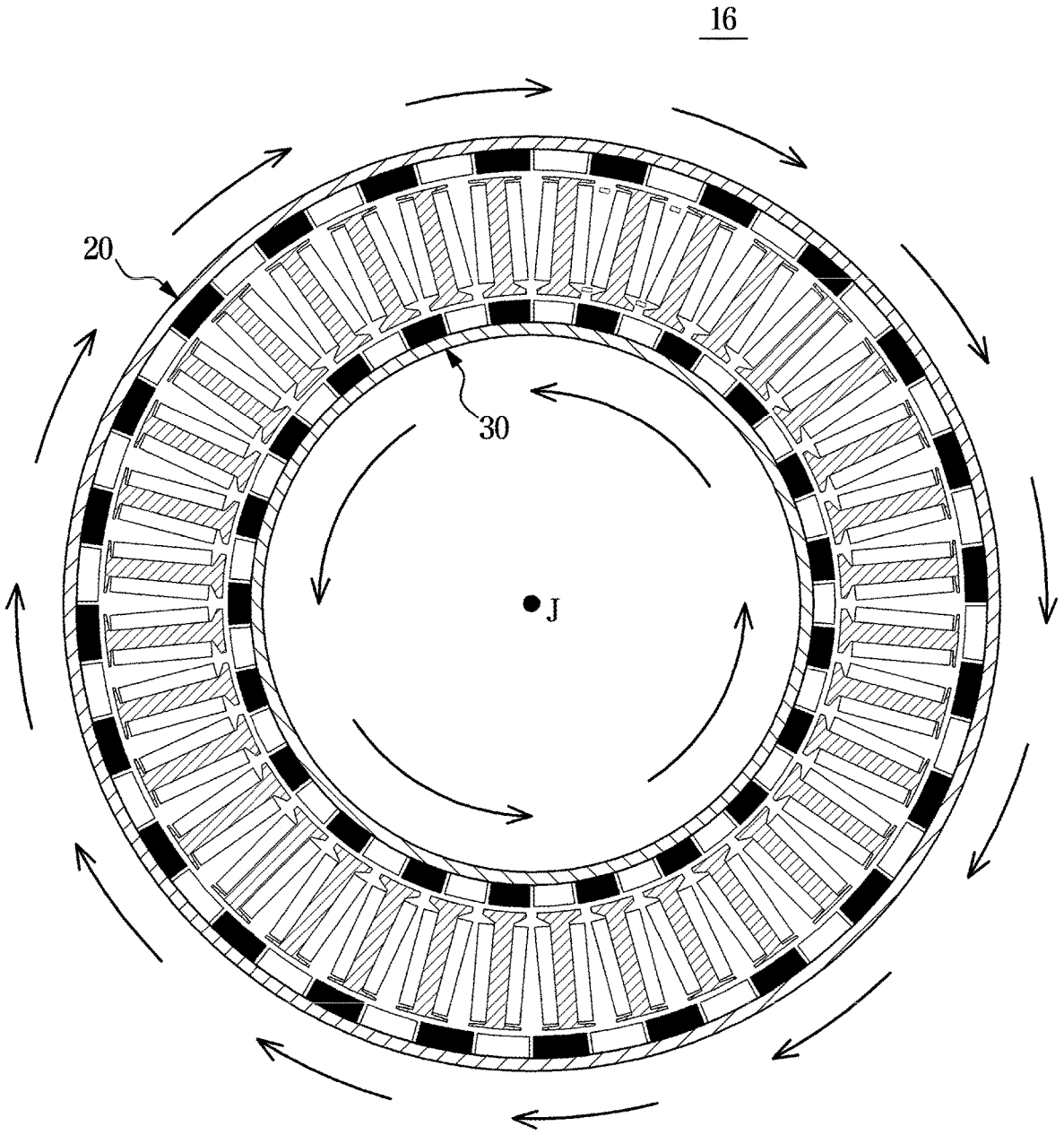
FIG. 5 is a view illustrating a state in which the motor of the washing machine according to an embodiment of the disclosure is driven in a third driving mode.

FIG. 3 is a view illustrating a state in which the motor of the washing machine according to an embodiment of the disclosure is driven in a first driving mode, FIG. 4 is a view illustrating a state in which the motor of the washing machine according to an embodiment of the disclosure is driven in a second driving mode, and FIG. 5 is a view illustrating a state in which the motor of the washing machine according to an embodiment of the disclosure is driven in a third driving mode.

Referring to FIG. 3, the motor 16 may be driven in the first driving mode in which the inner rotor 30 is stopped and only the outer rotor 20 is rotated.

According to an embodiment, in response to a six-phase current being supplied to the motor 16, the outer rotor 20 may be rotated, and the inner rotor 30 may not be rotated.

Referring to FIG. 4, the motor 16 may be driven in the second driving mode in which the outer rotor 20 is stopped and only the inner rotor 30 is rotated.

According to an embodiment, in response to a three-phase current being supplied to the motor 16, only the inner rotor 30 may be rotated, and the outer rotor may not be rotated.

Referring to FIG. 5, the motor 16 may be driven in the third driving mode in which both of the outer rotor 20 and the inner rotor 30 are rotated.

According to an embodiment, in response to a combined current of the six-phase current and the three-phase current being supplied to the motor 16, both of the inner rotor 30 and the outer rotor 20 may be rotated.

Particularly, in a state in which a short-pitch winding coefficient is defined as Kp, a distribution winding coefficient is defined as Kd, and a winding coefficient is defined as Kw, the inner rotor 30 may not be driven because Kp is 0.97, Kd is 0 (zero), and Kw is 0 (zero) with the six-phase current, but the inner rotor 30 may be driven because Kp is 0.97, Kd is 0.97, and Kw is 0.93 with the three-phase current.

On the other hand, the outer rotor 20 may be driven because Kp is 0.87, Kd is 0.87, and Kw is 0.75 with the six-phase current, but the outer rotor 20 may not be driven because Kp is 0.87, Kd is 0 (zero), and Kw is 0 (zero) with the three-phase current.

Figure 6:
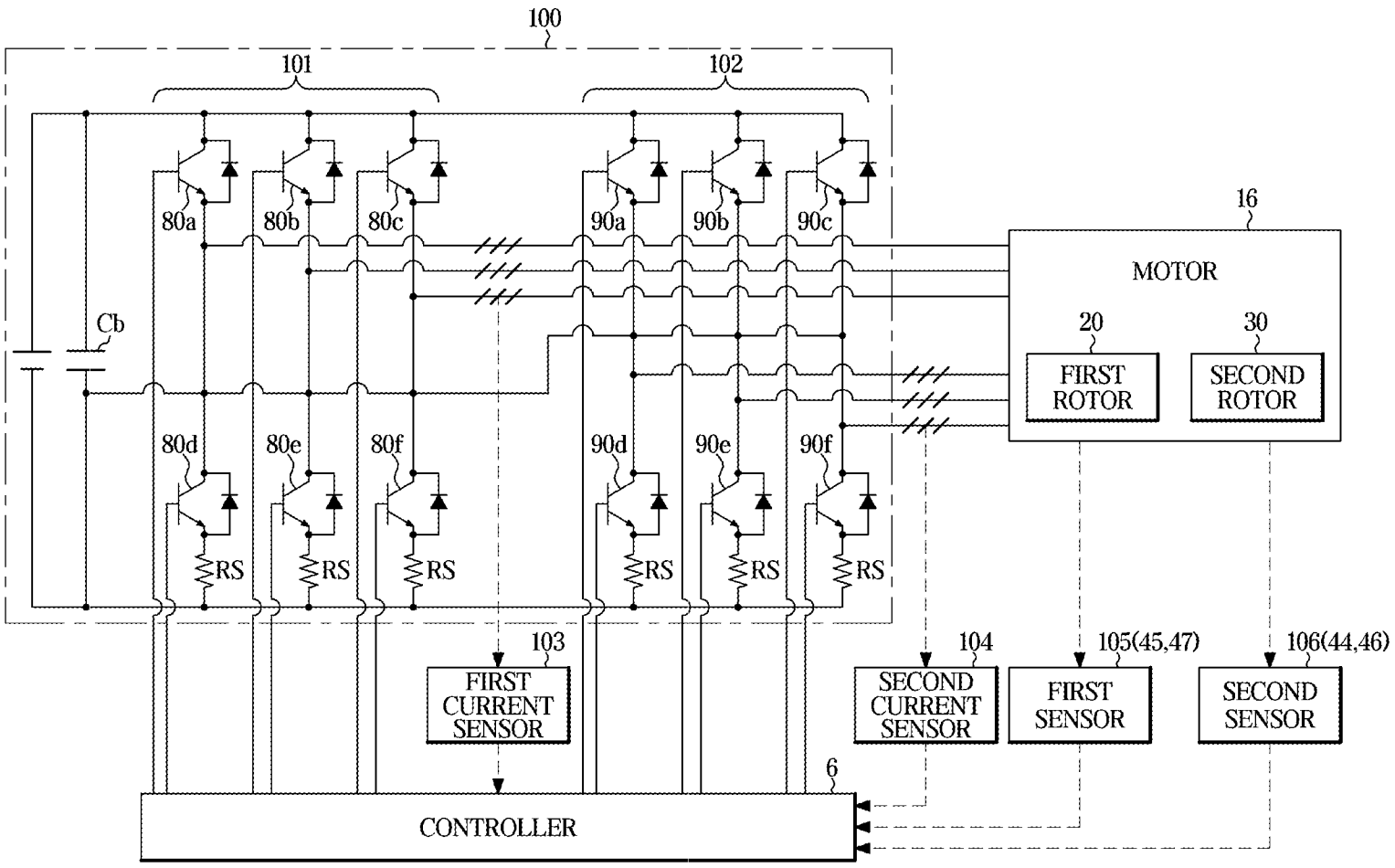
FIG. 6 is a diagram illustrating a structure of the motor, an inverter circuit, and a controller of the washing machine according to an embodiment of the disclosure.

FIG. 6 is a diagram illustrating a structure of the motor, an inverter circuit, and a controller of the washing machine according to an embodiment of the disclosure.

Referring to FIG. 6, the washing machine 1 may include an inverter circuit 100 connected to the motor 16 and including a first inverter 101 and a second inverter 102 connected in parallel to each other.

The first inverter 101 and the second inverter 102 may be connected to a common DC power supply.

The first inverter 101 and the second inverter 102 may be a three-phase inverter. The first inverter 101 may include three upper switching elements 80*a*, 80*b*, and 80*c* and three lower switching elements 80*d*, 80*e*, and 80*f*. The second inverter 102 may include three upper switching elements 90*a*, 90*b*, and 90*c* and three lower switching elements 90*d*, 90*e*, and 90*f*.

The plurality of switching elements 80*a* to 80*f* and 90*a* to 90*f* forming the inverter circuit 100 may be implemented as an insulated-gate bipolar transistor (IGBT).

Each of the six wires forming the coil 43 of the motor 16 may be connected to the first inverter 101 and the second inverter 102.

The controller 6 may input a pulse width modulated (PWM control) electric signal to the first inverter 101 and the second inverter 102 using a predetermined command signal and a carrier wave composed of a triangular wave, and apply a DC voltage to the motor 16.

Each of the switching elements 80*a* to 80*f*, 90*a* to 90*f* may be turned on or off based on the electrical signal (PWM control signal) output from the controller 6, and the power supply to the motor 16 may be controlled according to a combination of on/off.

According to an embodiment, the driving of the inner rotor 30 and the outer rotor 20 may be controlled according to a combination of on/off of each of the switching elements 80*a* to 80*f* and 90*a* to 90*f*.

According to various embodiments, the inverter circuit 100 may include a shunt resistor RS provided below the lower switching elements 80*d* to 80*f* and 90*d* to 90*f*, and the controller 6 may receive information about a voltage applied to both ends of the shunt resistor RS.

According to various embodiments, the inverter circuit 100 may further include a bootstrap capacitor Cb to which a voltage required to operate the switching elements 80*a* to 80*f* and 90*a* to 90*f* is charged. According to an embodiment, the bootstrap capacitor Cb may be provided to correspond to each pair of switching elements (for example, 80*a* & 80*d*, 80*b* & 80*e*, 80*c* & 80*f*, 90*a* & 90*d*, 90*b* & 90*e*, and 90*c* & 90*f*).

The bootstrap capacitor Cb may be charged in a state in which the lower switching elements 80*d* to 80*f* and 90*d* to 90*f* are turned on and the upper switching elements 80*a* to 80*c* and 90*a* to 90*c* are turned off.

Although not shown in the drawing, the inverter circuit 100 may further include a temperature sensing circuit configured to detect a temperature of the switching elements 80*a* to 80*f* and 90*a* to 90*d*. The temperature sensing circuit may be implemented in a known manner In addition, the inverter circuit 100 may further include an overcurrent detection circuit configured to detect an overcurrent of the switching elements 80*a* to 80*f* and 90*a* to 90*d*. The overcurrent detection circuit may be implemented in a known manner.

The inverter circuit 100 may include a first current sensor 103 configured to detect a current supplied to the motor 16 from the first inverter 101, and a second current sensor 104 configured to detect a current supplied to the motor 16 from the second inverter 102.

Information about the current detected by the first current sensor 103 and the second current sensor 104 may be transmitted to the controller 6.

According to an embodiment, the motor 16 may include a first sensor 105 configured to obtain state information of the outer rotor 20 and a second sensor 106 configured to obtain state information of the inner rotor 30.

The first sensor 105 may include the magnetic flux sensor 45 configured to detect the position of the outer rotor 20 and/or the speed sensor 47 configured to detect the speed of the outer rotor 20.

The second sensor 106 may include the magnetic flux sensor 44 configured to detect the position of the inner rotor 30 and/or the speed sensor 46 configured to detect the speed of the inner rotor 30.

Information obtained by the first sensor 105 and the second sensor 106 may be transmitted to the controller 6.

Based on a target rotation speed of the drum 11 and the pulsator 12 that is calculated from the detection current received from the first current sensor 103 and the second current sensor 104, and a detection rotation speed of the inner rotor 30 and the outer rotor 20 detected from the first sensor 105 and the second sensor 106, the controller 6 may correct the electrical signal (PWM control signal) input to the first inverter 101 and the second inverter 102 so as to allow the drum 11 and the pulsator 12 to be rotated at the target rotation speed.

Figure 7:
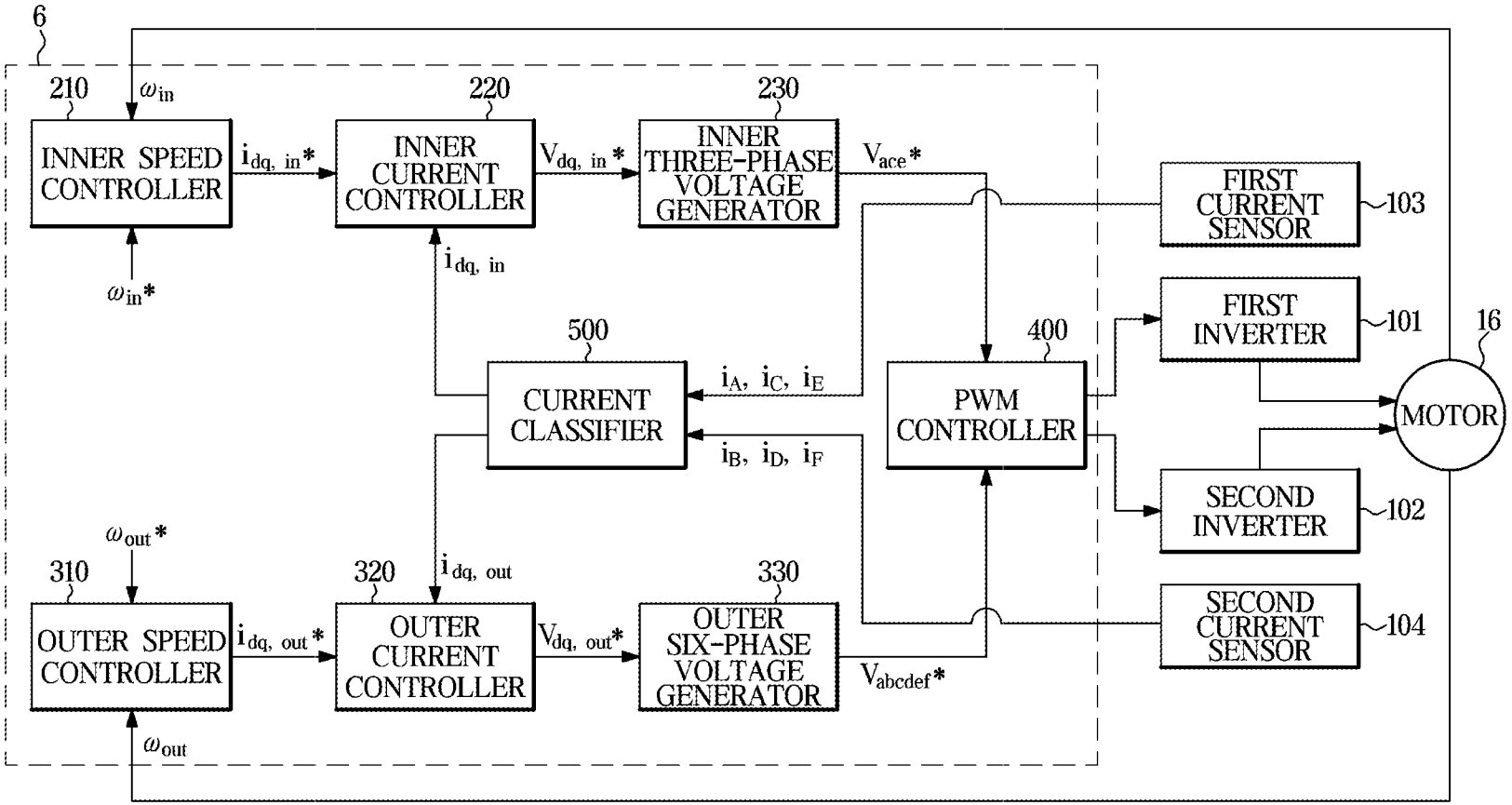
FIG. 7 is a control block diagram illustrating the controller according to an embodiment of the disclosure.

FIG. 7 is a control block diagram illustrating the controller according to an embodiment of the disclosure.

Referring to FIG. 7, the controller 6 may include an inner speed controller 210, an inner current controller 220, an inner three-phase voltage generator 230, an outer speed controller 310, an outer current controller 320, and an outer six-phase voltage generator 330, a pulse width modulation (PWM) controller 400, and a current classifier 500.

Although not shown in the drawings, the controller 6 may further include a coordinate converter configured to convert a three phase axis (a-axis, c-axis, and e-axis) of three-phase drive current values ($i_A$, $i_C$, $i_E$; $i_{ACE}$) and or three-phase drive voltage values ($V_a$, $V_b$, $V_C$; $V_{ace}$) into a Cartesian coordinate axis (a-axis, and β-axis) and/or a dq coordinate axis (d-axis, and q-axis) or configured to convert a six phase axis (a-axis, b-axis, c-axis, d-axis, e-axis, and f-axis) of six-phase drive current values ($i_A$, $i_B$, $i_C$ $i_D$ $i_E$ $i_F$; $i_{ABCDEF}$) and or six-phase drive voltage values ($V_a$, $V_b$, $V_C$, $V_d$, $V_e$, $V_f$, $V_{abcdef}$) into the Cartesian coordinate axis (a-axis, and β-axis) and/or the dq coordinate axis (d-axis, and q-axis).

Further, the controller 6 may further include a coordinate converter configured to convert the Cartesian coordinate axis (a-axis, and β-axis) into the dq coordinate axis (d-axis, and q-axis), configured to convert the dq coordinate axis (d-axis, and q-axis) into the Cartesian coordinate axis (a-axis, and β-axis) or configured to convert the Cartesian coordinate axis (a-axis, and β-axis) and/or the dq coordinate axis (d-axis, and q-axis) into the three phase axis (a-axis, c-axis, and e-axis) and/or the six phase axis (a-axis, b-axis, c-axis, d-axis, e-axis, and f-axis).

The current classifier 500 may classify the six-phase currents ($i_A$, $i_B$, $i_C$ $i_D$ $i_E$ $i_F$; $i_{ABCDEF}$) measured by the first current sensor 103 and the second current sensor 104 into a measured current for operating the inner current controller 220 and a measured current for operating the outer current controller 320.

According to an embodiment, according to the following [Equation 1], the current classifier 500 may calculate the measured current for the inner current controller 220 to operate in the Cartesian coordinate system.

$$\begin{bmatrix} i_{\alpha,in} \\ i_{\beta,in} \end{bmatrix} = \sqrt{\frac{1}{3}} \begin{bmatrix} 1 & -\frac{1}{2} & -\frac{1}{2} & 1 & -\frac{1}{2} & -\frac{1}{2} \\ 0 & \frac{\sqrt{3}}{2} & -\frac{\sqrt{3}}{2} & 0 & \frac{\sqrt{3}}{2} & -\frac{\sqrt{3}}{2} \end{bmatrix} \begin{bmatrix} i_A \\ i_B \\ i_C \\ i_D \\ i_E \\ i_F \end{bmatrix} \quad \text{[Equation 1]}$$

By a known method, the coordinate converter may convert the measured current ($i_{\alpha\beta,in}$) in the Cartesian coordinate axis into the dq coordinate axis so as to output the measured current ($i_{dq,in}$) for the inner current controller 220 to operate in the dq axis.

According to embodiment, according to the following [Equation 2], the current classifier 500 may calculate the measured current for the outer current controller 320 to operate in the Cartesian coordinate system.

$$\begin{bmatrix} i_{\alpha,out} \\ i_{\beta,out} \end{bmatrix} = \sqrt{\frac{1}{3}} \begin{bmatrix} 1 & \frac{1}{2} & \frac{1}{2} & -1 & -\frac{1}{2} & \frac{1}{2} \\ 0 & \frac{\sqrt{3}}{2} & \frac{\sqrt{3}}{2} & 0 & -\frac{\sqrt{3}}{2} & -\frac{\sqrt{3}}{2} \end{bmatrix} \begin{bmatrix} i_A \\ i_B \\ i_C \\ i_D \\ i_E \\ i_F \end{bmatrix} \quad \text{[Equation 2]}$$

By a known method, the coordinate converter may convert the measured current ($i_{\alpha\beta,out}$) in the Cartesian coordinate axis into the dq coordinate axis so as to output the measured current ($i_{dq.out}$) for the outer current controller 320 to operate in the dq axis.

The inner speed controller 210 may compare an inner rotation speed command ($\omega_{in}$*) of the controller 6 and a rotation speed value ($\omega_{in}$) of the inner rotor 30, and based on the comparison result, output a dq-axis current command ($i_{dq.in}$*). For example, by using a proportional integral control (PI control), the inner speed controller 210 may calculate the dq-axis current command ($i_{dq.in}$*) to be supplied to the inner rotor 30 based on a difference between the rotation speed command ($\omega_{in}$*) of the inner rotor 30 and the rotation speed value ($\omega_{in}$) of the inner rotor 30.

The inner current controller 220 may compare a dq-axis current command ($i_{dq.in}$*) output from the inner speed controller 210 with a dq-axis current value ($i_{dq.in}$) output from the current classifier 500, and based on the comparison result, output a dq-axis voltage command ($V_{dq.in}$*). Particularly, by using the PI control, the inner current controller 220 may determine a d-axis voltage command ($V_{d.in}$*) based on a difference between a d-axis current command ($I_{d.in}$*) and a d-axis current value ($I_{d.in}$), and determine a q-axis voltage command ($V_{q.in}$*) based on a difference between a q-axis current command ($I_{q.in}$*) and a q-axis current value ($I_{q.in}$).

The inner three-phase voltage generator 230 may convert the dq-axis voltage command ($V_{dq.in}$*) into a three-phase voltage command (α-phase voltage command, c-phase voltage command, e-phase voltage command:$V_{ace}$*) based on an electric angle of the inner rotor 30.

According to an embodiment, the inner three-phase voltage generator 230 may convert the dq-axis voltage command ($V_{dq.in}$*) into a αβ-axis voltage command ($V_{\alpha\beta.in}$*) and output the three-phase voltage command ($V_{ace}$*) according to the following [Equation 3].

$$\begin{bmatrix} V^*_{a,in} \\ V^*_{c,in} \\ V^*_{e,in} \end{bmatrix} = \sqrt{\frac{1}{3}} \begin{bmatrix} 1 & 0 \\ -\frac{1}{2} & \frac{\sqrt{3}}{2} \\ -\frac{1}{2} & -\frac{\sqrt{3}}{2} \end{bmatrix} \begin{bmatrix} V^*_{\alpha,in} \\ V^*_{\beta,in} \end{bmatrix} \quad \text{[Equation 3]}$$

The outer speed controller 310 may compare an outer rotation speed command ($\omega_{out}$*) of the controller 6 and a rotation speed value ($\omega_{out}$) of the outer rotor 20, and based on the comparison result, output a dq-axis current command ($i_{dq,out}$*). For example, by using the PI control, the outer speed controller 310 may calculate the dq-axis current command ($i_{dq,out}$*) based on a difference between the rotation speed command ($\omega_{out}$*) of the outer rotor 20 and the rotation speed value ($\omega_{out}$) of the outer rotor 20.

The outer current controller 320 may compare the dq-axis current command ($i_{dq.out}$*) output from the outer speed controller 310 with a dq-axis current value ($i_{dq,out}$) output from the current classifier 500, and based on the comparison result, output a dq-axis voltage command ($V_{dq.out}$*). Particularly, by using the PI control, the outer current controller 320 may determine a d-axis voltage command ($V_{d,out}$*) based on a difference between a d-axis current command ($I_{d,out}$*) and the d-axis current value ($I_{d,out}$), and determine a q-axis voltage command ($V_{q.out}$*) based on a difference between a q-axis current command ($I_{q.out}$*) and the q-axis current value ($I_{q,out}$).

The outer six-phase voltage generator 330 may convert the dq-axis voltage command ($V_{dq.out}$*) into a six-phase voltage command (α-phase voltage command, b-phase voltage command, c-phase voltage command, d-phase voltage command, e-phase voltage command, f-phase voltage command: $V_{abcdef}$*) based on an electric angle of the outer rotor 20.

According to an embodiment, the outer six-phase voltage generator 330 may convert the dq-axis voltage command ($V_{dq.out}$*) into a αβ-axis voltage command ($V_{\alpha\beta,out}$*) and output the six-phase voltage command ($V_{abcdef}$*) according to the following [Equation 4].

$$\begin{bmatrix} V^*_{a,out} \\ V^*_{b,out} \\ V^*_{c,out} \\ V^*_{d,out} \\ V^*_{e,out} \\ V^*_{f,out} \end{bmatrix} = \sqrt{\frac{1}{3}} \begin{bmatrix} 1 & 0 \\ \frac{1}{2} & \frac{\sqrt{3}}{2} \\ -\frac{1}{2} & \frac{\sqrt{3}}{2} \\ -1 & 0 \\ -\frac{1}{2} & -\frac{\sqrt{3}}{2} \\ \frac{1}{2} & -\frac{\sqrt{3}}{2} \end{bmatrix} \begin{bmatrix} V^*_{\alpha,out} \\ V^*_{\beta,out} \end{bmatrix} \quad \text{[Equation 4]}$$

The PWM controller 400 may output a PWM control signal for turning on or turning off the switching elements 80*a* to 80*f* and 90*a* to 90*f* of the inverter circuit 100 based on the inner three-phase voltage command ($V_{ace}$*) and the outer six-phase voltage command ($V_{abcdef}$*). Particularly, the PWM controller 400 may perform a pulse width modulation (PWM) on the inner three-phase voltage command ($V_{ace}$*) and the outer six-phase voltage command ($V_{abcdef}$*), and control the first inverter 101 and the second inverter 102 based on a pulse width modulated (PWM) signal.

Figure 8:
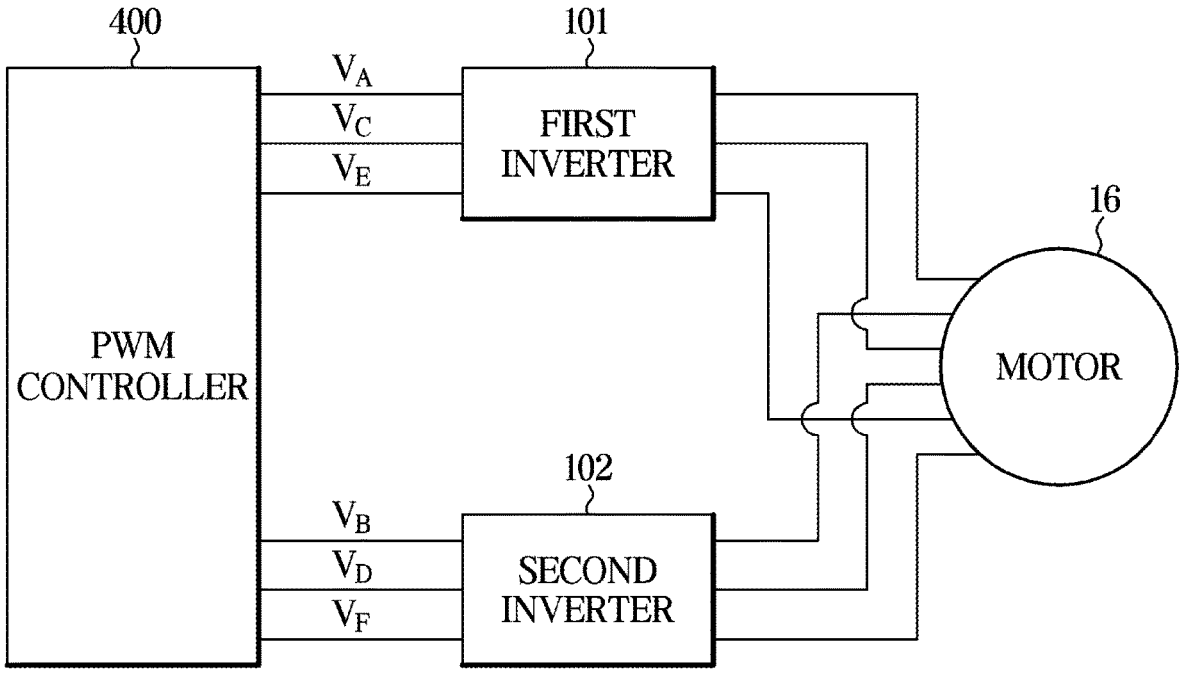
FIG. 8 is a diagram illustrating a state in which the controller according to an embodiment of the disclosure performs a pulse width modulation (PWM) control on the inverter circuit.

FIG. 8 is a diagram illustrating a state in which the controller 6 according to an embodiment of the disclosure performs a pulse width modulation (PWM) control on the inverter circuit 100.

Referring to FIG. 8, the PWM controller 400 may generate PWM signals corresponding to voltage commands ($V_A$, $V_B$, $V_C$, $V_D$, $V_E$, and $V_F$) for six wires (windings).

According to an embodiment, the PWM controller 400 may output each voltage command ($V_A$, $V_B$, $V_C$, $V_D$, $V_E$, and $V_F$) based on the following [Equation 5].

$$\begin{bmatrix} V_A \\ V_B \\ V_C \\ V_D \\ V_E \\ V_F \end{bmatrix} = \begin{bmatrix} V^*_{a,in} \\ V^*_{b,in} \\ V^*_{c,in} \\ V^*_{d,in} \\ V^*_{e,in} \\ V^*_{f,in} \end{bmatrix} + \begin{bmatrix} V^*_{a,out} \\ V^*_{b,out} \\ V^*_{c,out} \\ V^*_{d,out} \\ V^*_{e,out} \\ V^*_{f,out} \end{bmatrix} \quad \text{[Equation 5]}$$

As mentioned above, the controller 6 may drive the motor 16, and even if one of the inner rotor 30 or the outer rotor 20 of the motor 16 is driven, the controller 6 may control both the first inverter 101 and the second inverter 102.

According to various embodiments, the controller 6 may drive the motor 16 in a first driving mode by inputting the inner rotation speed command ($\omega_{in}$*) as 0 (zero) and by inputting the outer rotation speed command ($\omega_{out}$*) as a value corresponding to the target speed. The controller 6 may drive the motor 16 in a second driving mode by inputting the inner rotation speed command ($\omega_{in}$*) as the value corresponding to the target speed and by inputting the outer rotation speed command ($\omega_{out}$*) as 0 (zero). The controller 6 may drive the motor 16 in a third driving mode by inputting the inner rotation speed command ($\omega_{in}$*) as the value corresponding to the target speed and by inputting the outer rotation speed command ($\omega_{out}$*) as the value corresponding to the target speed.

According to an embodiment, the controller 6 may drive the motor 16 in the third driving mode in response to a washing process of the washing machine 1, the controller 6 may drive the motor 16 in the first driving mode in response to a rinsing process and/or a spin-drying process of the washing machine 1, and the controller 6 may drive the motor 16 in the second driving mode in response to other process (for example, water-washing process) of the washing machine 1

As an example, the controller 6 may control the inverter circuit 100 to allow the motor 16 to be driven in the third driving mode during the washing process, and the controller 6 may control the inverter circuit 100 to allow the motor 16 to be driven in the first driving mode during the rinsing process.

According to the disclosure, the current classifier 500 may classify the detection current detected from the current sensors 103 and 104 into a detection current of the inner rotor 30 and a detection current of the outer rotor 20, and may classify the output of the PWM control signal of the inverter circuit 100 into an electrical signal output to the first inverter 101 and an electrical signal output to the second inverter 102, thereby performing the PWM control on both of the plurality of inverters 101 and 102.

Figure 9:
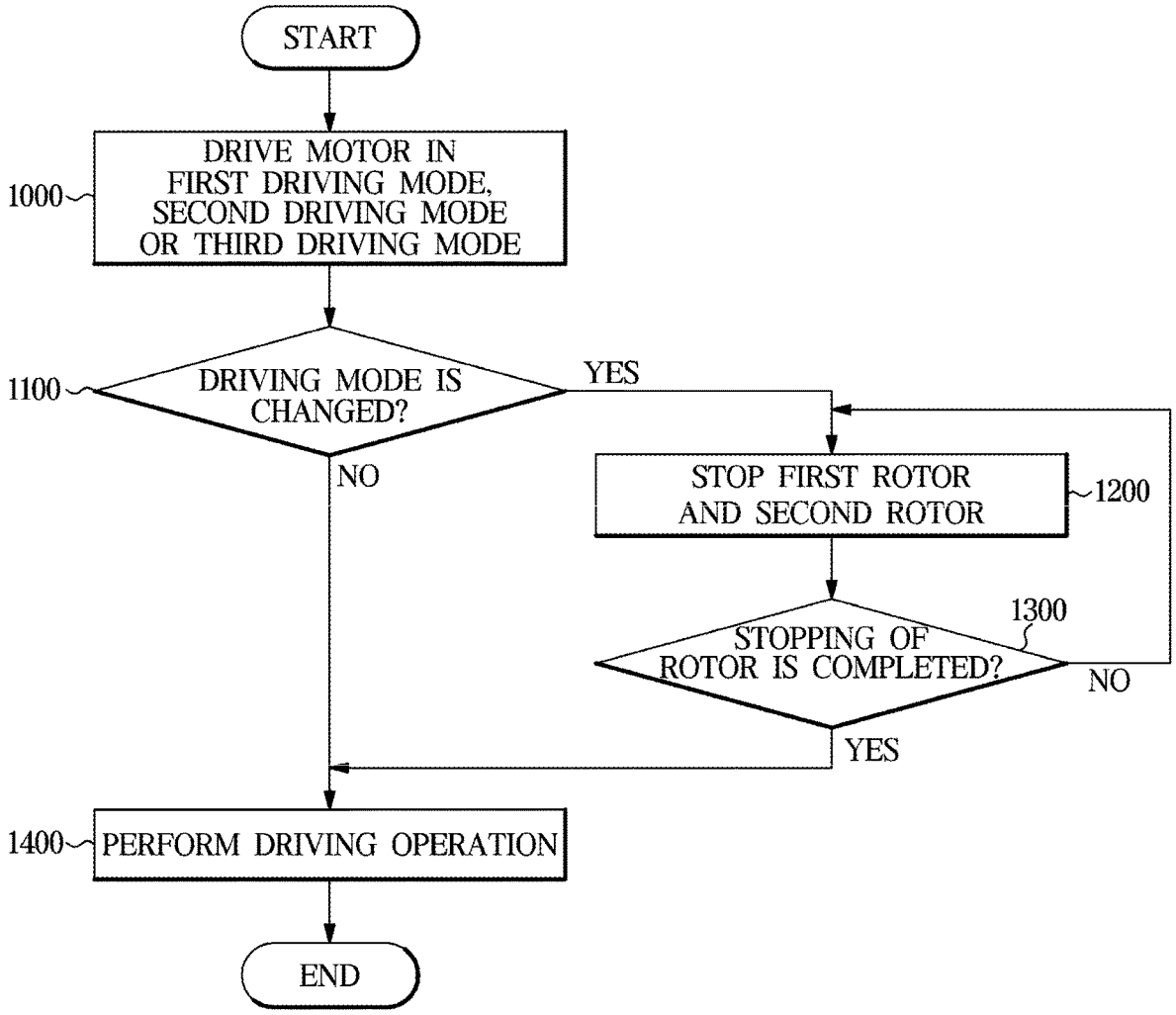
FIG. 9 is a flowchart illustrating a control method of the washing machine according to an embodiment of the disclosure.

FIG. 9 is a flowchart illustrating a control method of the washing machine according to an embodiment of the disclosure.

Referring to FIG. 9, the controller 6 may drive the motor 16 in the first driving mode, the second driving mode, or the third driving mode (1000).

In response to a change in the driving mode of the motor 16 (yes in 1010) during the motor 16 is driven in the first driving mode, the second driving mode, or the third driving mode, the controller 6 may control the inverter circuit 100 to stop both the inner rotor 30 and the outer rotor 20 based on the change in the driving mode of the motor 16 (1200).

Particularly, according to an embodiment, in response to the change in which the driving mode of the motor 16 is switched from one driving mode to another driving mode among the first driving mode, the second driving mode, and the third driving mode, the controller 6 may stop both the inner rotor 30 and the outer rotor 20 regardless of the driving mode before the change or the driving mode after the change.

For example, in response to a change in which the process of the washing machine 1 is changed from a first process (for example, the washing process) into a second process (for example, the rinsing process), the driving mode of the motor 16 may be changed.

According to various embodiments, in response to a change in which the driving mode of the motor 16 is changed from the first driving mode into the third driving mode, the controller 6 may control the inverter circuit 100 to stop the rotating outer rotor 20.

Further, in response to a change in which the driving mode of the motor 16 is changed from the second driving mode into the third driving mode, the controller 6 may control the inverter circuit 100 to stop the rotating inner rotor 30.

Further, in response to a change in which the driving mode of the motor 16 is changed from the third driving mode into the first or second driving mode, the controller 6 may control the inverter circuit 100 to stop both the rotating inner rotor 30 and the rotating outer rotor 20.

According to another embodiment, in response to a change in which the driving mode of the motor 16 is changed from the first driving mode into the second driving mode, the controller 6 may control the inverter circuit 100 to stop the outer rotor 20, and in response to a change in which the driving mode of the motor 16 is changed from the second driving mode into the first driving mode, the controller 6 may control the inverter circuit 100 to stop the inner rotor 30.

In response to the stopping of the inner rotor 30 and the outer rotor 20 (yes in 1300), the controller 6 may perform a driving operation corresponding to the changed driving mode (1400).

For example, in response to the change in which the driving mode of the motor 16 is changed from the first driving mode into the third driving mode, the controller 6 may perform a driving operation in which the outer rotor 20 is stopped and then both the inner rotor 30 and the outer rotor 20 are rotated.

According to a conventional manner, in order to drive the other one of the inner rotor 30 and the outer rotor 20 which is not rotating during one of the inner rotor 30 and the outer rotor 20 is rotating, it is possible to immediately drive the other one of the inner rotor 30 and the outer rotor 20 to rotate without stopping the rotating of the one of the inner rotor 30 and the outer rotor 20. Therefore, it is difficult to synchronize the PWM control signal output to the plurality of inverters from the controller 6, and thus a driving stability of the motor 16 is impaired or abnormal noise is generated.

According to an embodiment, even in the first driving mode or the second driving mode of the motor 16, the controller 6 may perform the PWM control on both the first inverter 101 and the second inverter 102, and thus there may be a risk in which a period of the PWM signal applied to the first inverter 101 and the second inverter 102 is changed according to the change in the driving mode.

According to the disclosure, in order to rotate the other one of the inner rotor and the outer rotor 20 which is not rotating during one of the inner rotor 30 and the outer rotor 20 is rotating, it is possible to stop the rotating of the one of the inner rotor 30, and then drive both the inner rotor 30 and the outer rotor 20 to rotate. Accordingly, it is possible to secure the driving stability of the motor 16 and to prevent the generation of the abnormal noise.

Further, in order to rotate only one of the inner rotor 30 and the outer rotor 20 during both the inner rotor 30 and the outer rotor 20 are rotating, it is possible to stop the rotating of both inner rotor 30 and outer rotor 20 and then drive the one of the inner rotor 30 and the outer rotor 20 only. Accordingly, it is possible to secure the driving stability of the motor 16 and to prevent the generation of the abnormal noise.

Further, in order to stop the rotating of one of the inner rotor 30 and the outer rotor 20 during the one of the inner rotor 30 and the outer rotor 20 is rotating and the other one of the inner rotor 30 and the outer rotor 30 which is not rotating, it is possible to stop the rotating of the one of the inner rotor 30 and the outer rotor 20 and then drive the other one of the inner rotor 30 and the outer rotor 20 which is not rotating. Accordingly, it is possible to secure the driving stability of the motor 16 and to prevent the generation of the abnormal noise.

In addition, as will be described later, according to the disclosure, it is possible to simultaneously start the PWM control on the first inverter 101 and the second inverter 102 while performing the driving operation. Therefore, it is possible to facilitate the synchronization of the inverter circuit 100.

Figure 10:
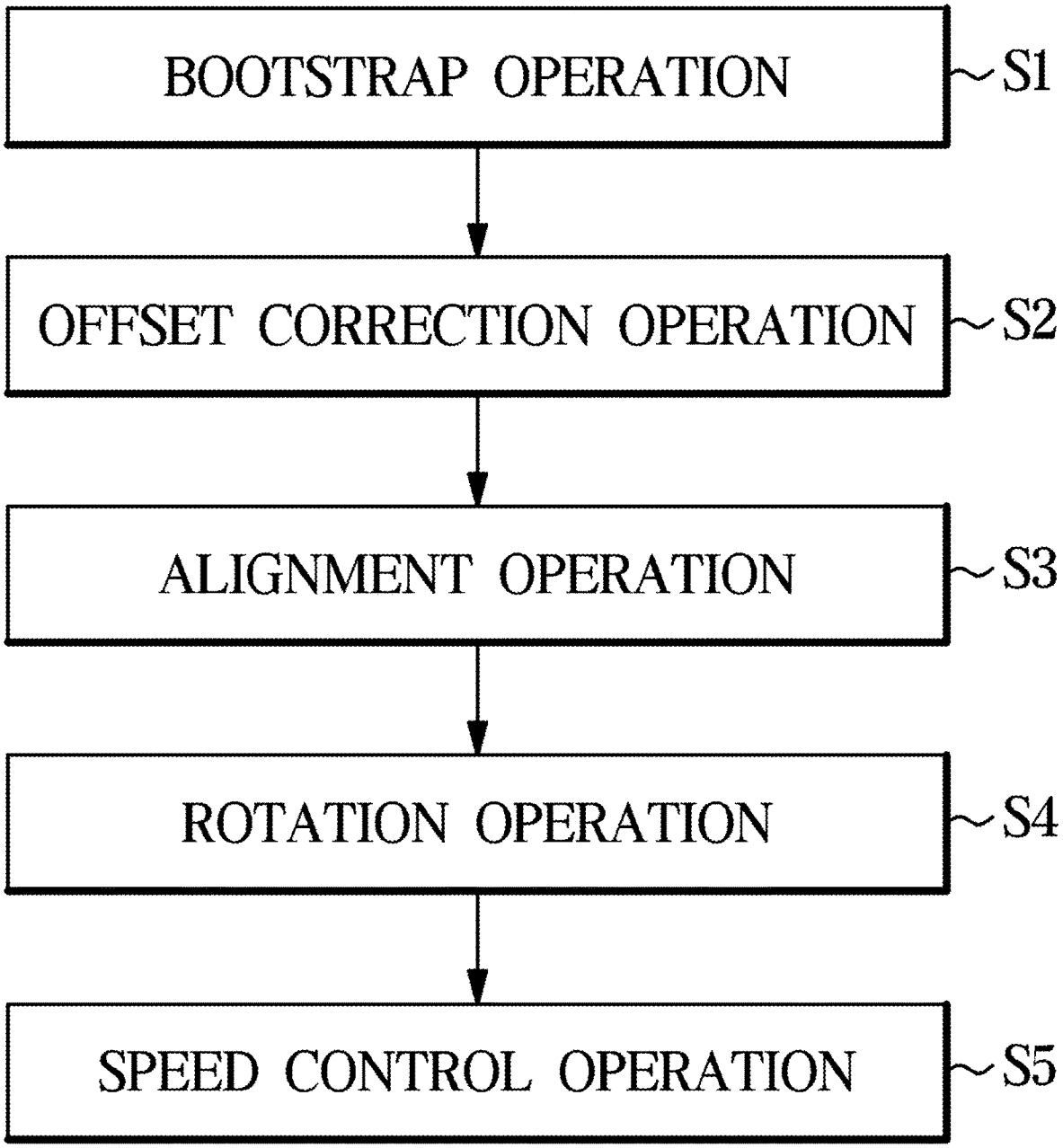
FIG. 10 is a flowchart illustrating a driving operation of the washing machine according to an embodiment of the disclosure.
Figure 11:
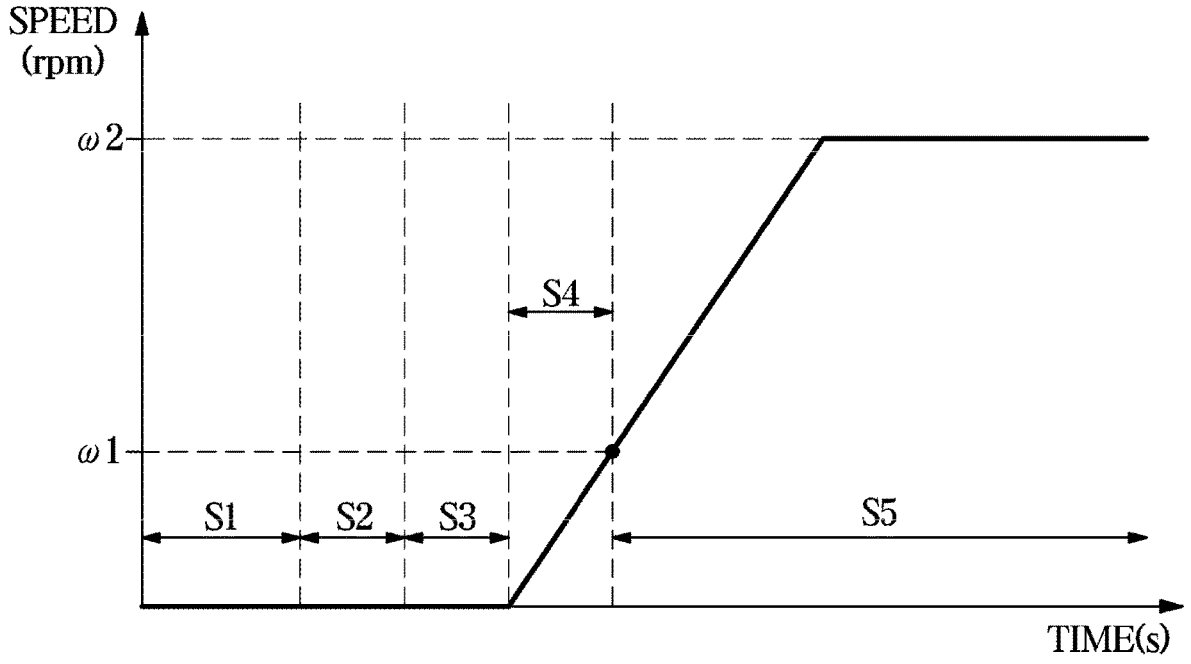
FIG. 11 is a graph illustrating a rotation speed of the motor corresponding to a driving operation according to an embodiment of the disclosure.

FIG. 10 is a flowchart illustrating a driving operation of the washing machine according to an embodiment of the disclosure, and FIG. 11 is a graph illustrating a rotation speed of the motor corresponding to a driving operation according to an embodiment of the disclosure.

Referring to FIG. 10, in response to the change in the driving mode during at least one of the inner rotor 30 or the outer rotor 20 is rotated, the controller 6 may stop the rotating rotor between the inner rotor 30 or the outer rotor 20, and after the rotating rotor is stopped, the controller 6 may perform the driving operation.

According to an embodiment, the driving operation may include a bootstrap operation S1, an offset correction operation S2, an alignment operation S3, a rotation operation S4, and a speed control operation S5.

According to various embodiments, the bootstrap operation S1, the offset correction operation S2, the alignment operation S3, the rotation operation S4, and the speed control operation S5 may be sequentially performed, and alternatively, some operations (for example, S1 and S2) may be omitted and the sequence thereof may be changed.

The bootstrap operation S1 refers to an operation for charging the bootstrap capacitor Cb included in the inverter circuit 100.

According to an embodiment, the controller 6 may perform the bootstrap operation S1 by turning off the plurality of upper switching elements 80*a* to 80*c* and 90*a* to 90*c* and by turning on the plurality of lower switching elements 80*d* to 80*f* and 90*d* to 90*f* included in the inverter circuit 100 for a predetermined time.

The offset correction operation S2 refers to an operation for correcting an offset of the inverter circuit 100.

According to an embodiment, the controller 6 may perform the offset correction operation S2 by comparing a voltage value at both ends of the shunt resistor RS located under the plurality of lower switching elements 80*c* to 80*f* and 90*c* to 90*f* with a predetermined reference voltage value.

According an embodiment, after the completion of the bootstrap operation S1, the controller 6 may perform the offset correction operation S2 while maintaining the states of the plurality of switching elements (the upper switching element: OFF/the lower switching element: ON).

The controller 6 may correct a driving current value for driving the motor 16 based on a difference between the voltage value of both ends of the shunt resistor RS and the reference voltage value.

In addition, in response to the difference, between the voltage value of both ends of the shunt resistor RS and the reference voltage value, being greater than or equal to a predetermined value, the controller 6 may compare the voltage value of both ends of the shunt resistor RS with the reference voltage value, again. In response to the number of the comparison being greater than or equal to a predetermined number of times, the controller 6 may determine that the inverter circuit 100 is broken.

In response to the determination that the inverter circuit 100 is broken, the controller 6 may control components such as the control panel 5 including the display, so as to notify the user of the failure of the inverter circuit 100.

The controller 6 may perform the offset correction operation for each of the first inverter 101 and the second inverter 102, and in response to the completion of the offset correction operation for both the first inverter 101 and the second inverter 102, the controller 6 may perform the next operation (for example, S3, S4 and S5) for driving the motor 16.

The alignment operation S3 refers to an operation for aligning at least one of the first rotor and the second rotor to a predetermined position angle.

According to an embodiment, the controller 6 may perform the PWM control on the first inverter 101 and the second inverter 102 to align the inner rotor 30 and the outer rotor 20 to the predetermined position angle.

The rotation operation S4 refers to an operation for forcibly rotating at least one of the inner rotor 30 or the outer rotor 20 by increasing the supply voltage, so as to allow the at least one of the inner rotor 30 or the outer rotor 20 to be rotated to a predetermined speed ω1.

According to an embodiment, the controller 6 may perform the PWM control on the first inverter 101 and the second inverter 102 to allow the at least one of the inner rotor 30 or the outer rotor 20 to be rotated to the predetermined speed ω1.

In the first driving mode, the controller 6 may perform the PWM control on the first inverter 101 and the second inverter 102 to rotate the outer rotor 20 to the predetermined speed. In the second driving mode, the controller 6 may perform the PWM control on the first inverter 101 and the second inverter 102 to rotate the inner rotor 30 to the predetermined speed. In the third driving mode, the controller 6 may perform the PWM control on the first inverter 101 and the second inverter 102 to rotate the inner rotor 30 and the outer rotor 20 to the predetermined speed.

The speed control operation S5 refers to an operation for a feedback control to allow at least one of the inner rotor 30 and the outer rotor 20 to follow a target speed ω2.

According to an embodiment, the controller 6 may perform the PWM control on the first inverter 101 and the second inverter 102 to allow the outer rotation speed command ($\omega_{out}$*) and the rotation speed value ($\omega_{out}$) of the outer rotor 20 to be equal to each other, or the inner rotation speed command ($\omega_{in}$*) and the rotation speed value ($\omega_{in}$) of the inner rotor 30.

In the first driving mode, the controller 6 may perform the PWM control on the first inverter 101 and the second inverter 102 to rotate the outer rotor 20 at the target speed ($\omega_{out}$*). In the second driving mode, the controller 6 may perform the PWM control on the first inverter 101 and the second inverter 102 to rotate the inner rotor 30 at the target speed ($\omega_{in}$*). In the third driving mode, the controller 6 may perform the PWM control on the first inverter 101 and the second inverter 102 to rotate the inner rotor 30 and the outer rotor 20 at the target speed ($\omega_{in}$* and $\omega_{out}$*), respectively.

As described above, in a state of using two inverters: the first inverter 101 and the second inverter 102, it is required to synchronize the PWM control according to the driving sequence of the motor 16, and thus a transition timing of the PWM control is important.

According to an embodiment, the controller 6 may simultaneously start the PWM control on the first inverter 101 and the second inverter 102 in response to the completion of the offset correction operation S2 on the first inverter 101 and the second inverter 102, before the alignment operation S3 in which the PWM control starts.

According to the disclosure, in response to the change in the driving mode of the motor 16, it is possible to perform the driving operation after stopping all rotors, and thus it is possible to synchronize a timing of the PWM control on the first inverter 101 and the second inverter 102.

Figure 12:
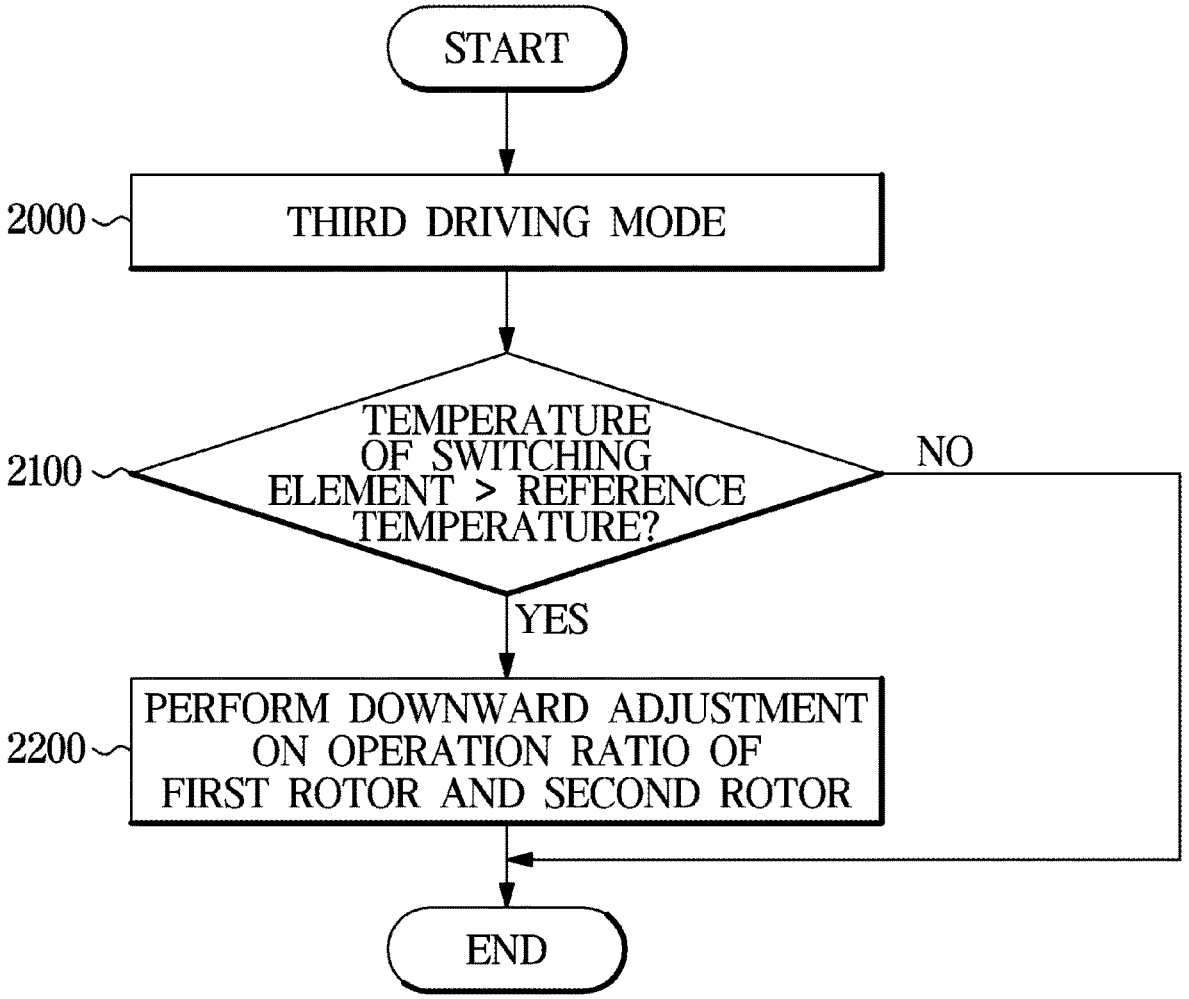
FIG. 12 is a flowchart illustrating a procedure of an operation ratio control according to an embodiment of the disclosure.

FIG. 12 is a flowchart illustrating a procedure of an operation ratio control according to an embodiment of the disclosure.

According to an embodiment, the controller 6 may drive the motor 16 in the third driving mode (2000).

For example, the controller 6 may drive the motor 16 in the third driving mode in the washing process.

According to various embodiments, the controller 6 may obtain temperature information for each of the plurality of switching elements 80*a* to 80*f* and 90*a* to 90*f* from the temperature sensing circuit included in the inverter circuit 100.

Based on a temperature of at least one of the plurality of switching elements 80*a* to 80*f* and 90*a* to 90*f* exceeding a reference temperature (yes in 2100), the controller 6 may rotate the inner rotor 30 and the outer rotor 20 through an operation ratio control instead of controlling the inner rotor 30 and the outer rotor 20 to be maintained at the target speed through the PWM control signal.

For example, the controller 6 may perform the operation ratio control by adjusting an operation ratio (duty of on-time to off-time) of the switching elements of the inverter circuit 100 to a predetermined duty.

The controller 6 may perform a downward adjustment on an operation ratio of the inner rotor 30 and an operation ratio of the outer rotor 20 based on a temperature of at least one of the plurality of switching elements 80*a* to 80*f* included in the first inverter 101 exceeding the reference temperature or based on a temperature of at least one of the plurality of switching elements 90*a* to 90*f* included in the second inverter 102 exceeding the reference temperature (2200).

The controller 6 may control the inverter circuit 100 to allow the operation ratio of the inner rotor 30 and the operation ratio of the outer rotor 20 to be equal to each other.

According to the disclosure, even if a difficulty occurs in the switching element included in one of the first inverter 101 or the second inverter 102, both the first inverter 101 and the second inverter 102 may be operated at the same operation ratio, and thus it is possible to prevent the circuit breakage.

Figure 13:
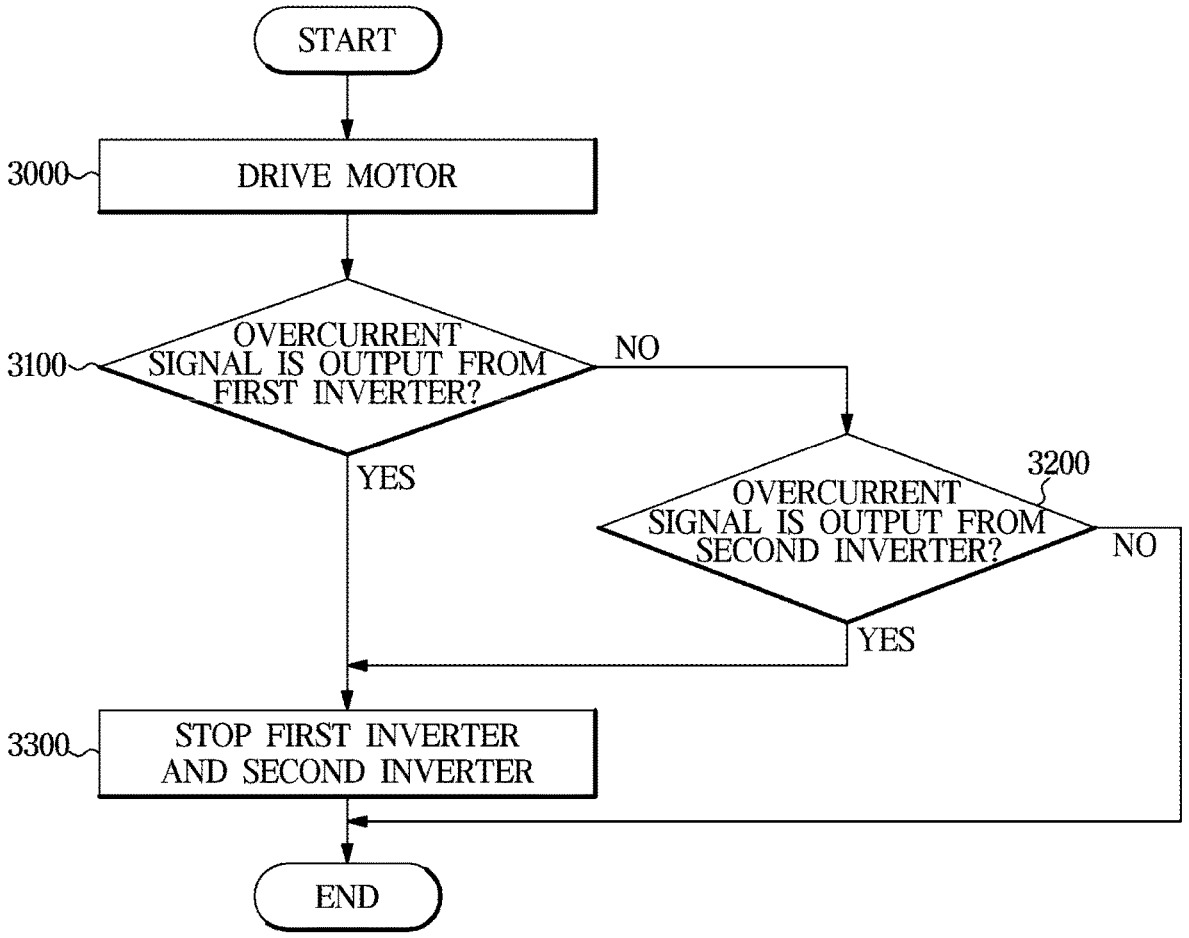
FIG. 13 is a flowchart illustrating a procedure of an inverter protection control according to an embodiment of the disclosure.

FIG. 13 is a flowchart illustrating a procedure of an inverter protection control according to an embodiment of the disclosure.

Referring to FIG. 13, the controller 6 may drive the motor 16 in one of the first driving mode, the second driving mode, or the third driving mode (3000).

According to various embodiments, the controller 6 may receive an overcurrent signal output from an overcurrent detection circuit included in the inverter circuit 100. For example, the controller 6 may receive a first overcurrent signal output from a first overcurrent detection circuit configured to detect the overcurrent of the first inverter 101 and/or a second overcurrent signal output from a second overcurrent detection circuit configured to detect the overcurrent of the second inverter 102.

In response to the overcurrent signal being output from one of the first inverter 101 or the second inverter 102 during the driving of the motor 16 (yes in 3100 or yes in 3200), the controller 6 may stop both the first inverter 101 and the second inverter 102 (3300).

According to the disclosure, by stopping both the first inverter 101 and the second inverter 102 in response to an abnormality occurring in one of the first inverter 101 and the second inverter 102 which are synchronously controlled, it is possible to prevent the damage in the switching element.

Figure 14:
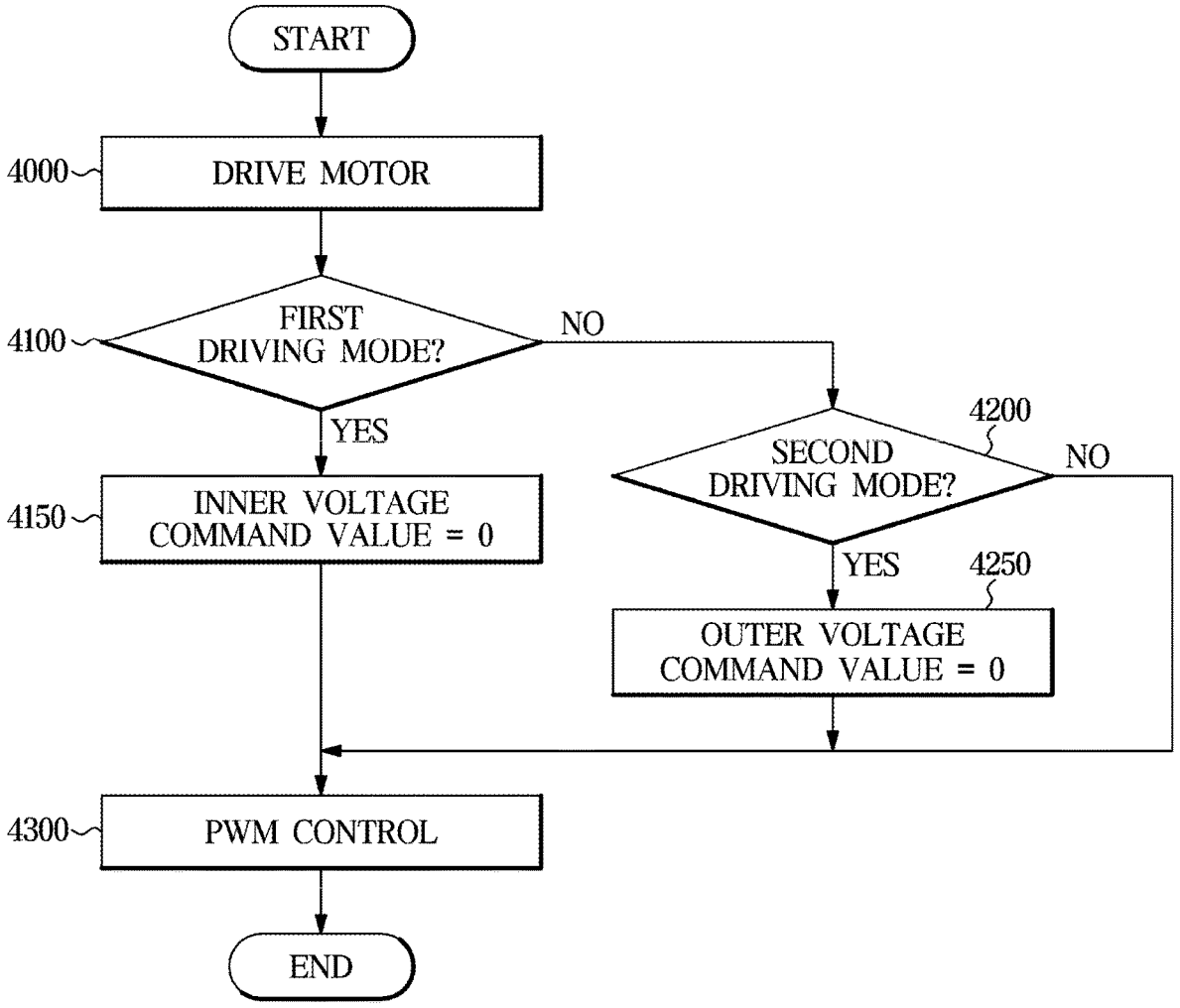
FIG. 14 is a flowchart illustrating a procedure of a motor driving control according to an embodiment of the disclosure.

FIG. 14 is a flowchart illustrating a procedure of a motor driving control according to an embodiment of the disclosure.

Referring to FIG. 14, the controller 6 may drive the motor 16 in one of the first driving mode, the second driving mode, or the third driving mode (4000).

According to an embodiment, in response to the first driving mode of the motor 16 (yes in 4100) that is the outer rotation speed command ($\omega_{out}$*) is present, and the value of the inner rotation speed command ($\omega_{in}$*) is 0 (zero), the controller 6 may output a signal for changing the inner voltage command value ($V_{dq.in}$*), which is for controlling the inner rotor 30, to 0 (zero) (4150).

The signal for changing the inner voltage command value ($V_{dq.in}$*), which is for controlling the inner rotor 30, to 0 (zero) refers to a signal provided to change the inner voltage command value ($V_{dq.in}$*) to 0 (zero) independent of the inner speed command value ($\omega_{in}$*) or the inner current command value ($i_{dq.in}$*).

In other words, the signal for changing the inner voltage command value ($V_{dq.in}$*) to 0 (zero) refers to a signal provided to change the inner voltage command value ($V_{dq.in}$*) to 0 (zero) regardless of the inner speed command value ($\omega_{out}$*) or the inner current command value ($i_{dq.in}$*).

According to an embodiment, in response to the second driving mode of the motor 16 (yes in 4200) that is the inner rotation speed command ($\omega_{in}$*) is present, and the value of the outer rotation speed command ($\omega_{out}$*) is 0 (zero), the controller 6 may output a signal for changing the outer voltage command value ($V_{dq.out}$*), which is for controlling the outer rotor 20, to 0 (zero) (4250).

The signal for changing the voltage command value ($V_{dq.out}$*), which is for controlling the outer rotor 20, to 0 (zero) refers to a signal provided to change the outer voltage command value ($V_{dq.out}$*) to 0 (zero) independent of the outer rotation speed command value ($\omega_{out}$*) or the outer current command value ($i_{dq,out}$*).

In other words, the signal for changing the outer voltage command value ($V_{dq.out}$*) to 0 (zero) refers to a signal provided to change the outer voltage command value ($V_{dq.out}$*) to 0 (zero) regardless of the outer speed command value ($\omega_{out}$*) or the outer current command value ($i_{dq.out}$*).

The controller 6 may perform the PWM control on the inverter circuit 100 based on the voltage commands ($V_A$, $V_B$, $V_C$, $V_D$, $V_E$, and $V_F$) output from the PWM controller 400 (4300).

In the first driving mode or the second driving mode, the stationary rotor (for example, the inner rotor 30 or the outer rotor 20) is required to be fixed. However, in fact, the rotor that is required to be stopped may be rotated due to the leakage magnetic flux or a force applied to the laundry. In response to the rotation of the rotor that is required to be stopped, the driving current ($i_A$, $i_B$, $i_C$, $i_D$, $i_E$, and $i_F$) may be measured. Accordingly, the voltage command ($V_{dq.in}$*and $V_{dq.out}$*) may be output by the current controller 220 and 320, and thus the distortion may occur in the voltage, which is output to the inverter circuit 100, due to an unintentional voltage command ($V_{dq.in}$*and $V_{dq.out}$*). Therefore, the abnormal noise and step-out may occur.

According to the disclosure, by changing the voltage command value ($V_{dq.in}$*and $V_{dq.out}$*) for controlling the rotor, which is not rotated in the first driving mode or the second driving mode, to 0 (zero), it is possible to prevent the abnormal noise and step-out caused by the voltage command that is unintentionally output.

As is apparent from the above description, it is possible to prevent noise that occurs due to a change in a driving mode of a motor.

Further, it is possible to secure a driving stability of a motor so as to prevent a failure in the motor.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which can be decoded by a computer are stored. For example, there may be a Read Only Memory (ROM), a Random Access Memory (RAM), a magnetic tape, a magnetic disk, a flash memory, and an optical data storage device.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:
a drum;
a pulsator;
a motor comprising:
a stator;
a first rotor connected to the drum; and
a second rotor connected to the pulsator;
an inverter circuit connected to the motor, the inverter circuit comprising:
a first inverter configured to drive the first rotor; and
a second inverter configured to drive the second rotor; and
at least one processor configured to:
selectively control the inverter circuit to drive the motor based on a plurality of driving modes, the plurality of driving modes including:
a first driving mode to rotate only the first rotor;
a second driving mode to rotate only the second rotor; and
a third driving mode to rotate both the first rotor and the second rotor;
in response to changing from one of the plurality of driving modes to another one of the plurality of driving modes, control the inverter circuit to start a driving operation of the changed driving mode and stop both the first rotor and the second rotor; and
in response to both the first rotor and the second rotor being stopped, control the inverter circuit to drive the motor based on the changed driving mode,
wherein the driving operation comprises an alignment operation to align the first rotor and the second rotor to a predetermined angle, and
wherein the at least one processor is further configured to perform the alignment operation by performing a pulse width modulation (PWM) control on the first inverter and the second inverter simultaneously in the first driving mode or in the second driving mode.

2. The washing machine of claim 1, wherein
the at least one processor is further configured to control the inverter circuit to stop the first rotor in response to the changing of the driving mode of the motor from the first driving mode to the third driving mode.

3. The washing machine of claim 1, wherein
the at least one processor is further configured to control the inverter circuit to stop the second rotor in response to the changing of the driving mode of the motor from the second driving mode to the third driving mode.

4. The washing machine of claim 1, wherein
the at least one processor is further configured to control the inverter circuit to stop both the first rotor and the second rotor in response to the changing of the driving mode of the motor from the third driving mode to the first driving mode or to the second driving mode.

5. The washing machine of claim 1, wherein
the at least one processor is further configured to:
control the inverter circuit to stop the first rotor in response to the changing of the driving mode of the motor from the first driving mode to the second driving mode, and
control the inverter circuit to start the driving operation of the second driving mode to rotate the second rotor only in response to the stopping of the first rotor.

6. The washing machine of claim 1, wherein
the at least one processor is further configured to:
control the inverter circuit to stop the second rotor in response to the changing of the driving mode of the motor from the second driving mode to the first driving mode, and
control the inverter circuit to start the driving operation of the first driving mode to rotate the first rotor only in response to the stopping of the second rotor.

7. The washing machine of claim 1, wherein
a timing of the PWM control for both the first inverter and the second inverter is synchronized while performing the driving operation of the first driving mode or the second driving mode.

8. The washing machine of claim 7, wherein
the at least one processor is further configured to:
output a signal for changing a voltage command value to control the second rotor in the first driving mode, to 0 (zero) regardless of a speed command value or a current command value; and output a signal for changing a voltage command value to control the first rotor in the second driving mode, to 0 (zero) regardless of a speed command value or a current command value.

9. The washing machine of claim 1, wherein the at least one processor is further configured to control the inverter circuit to start the driving operation of the first driving mode to rotate the first rotor only or the driving operation of the second driving mode to rotate the second rotor only in response to the stopping of both the first rotor and the second rotor.

10. The washing machine of claim 1, wherein the inverter circuit includes a plurality of upper switching elements and a plurality of lower switching elements to control the driving of the motor, and the driving operation further comprises:

a bootstrap operation to turn off the plurality of upper switching elements and turn on the plurality of lower switching elements;

an offset correction operation to compare a voltage value at both ends of a shunt resistor included in the inverter circuit with a reference voltage value;

a rotation operation to rotate at least one of the first rotor and the second rotor at a reference speed; and a speed control operation to rotate at least one of the first rotor and the second rotor at a target speed, and wherein the alignment operation is performed after the offset correction operation and before the rotation operation.

11. The washing machine of claim 10, wherein the at least one processor is further configured to simultaneously start the PWM control on the first inverter and the second inverter based on completing of the offset correction operation.

12. The washing machine of claim 1, wherein the at least one processor is further configured to control the inverter circuit such that an operation ratio of the first rotor and an operation ratio of the second rotor are equal to each other.

13. The washing machine of claim 1, wherein the inverter circuit comprises a first inverter and a second inverter connected in parallel to each other, and the at least one processor is further configured to stop driving the first inverter and the second inverter in response to an overcurrent signal being output from one of the first inverter or the second inverter.

14. The washing machine of claim 1, wherein the at least one processor is further configured to:

control the inverter circuit to supply a six-phase current to the motor in the first driving mode;

control the inverter circuit to supply a three-phase current to the motor in the second driving mode; and control the inverter circuit to supply a combined current, in which the three-phase current and the six-phase current are combined, to the motor in the third driving mode.

15. The washing machine of claim 2, wherein the at least one processor is further configured to control the inverter circuit to start the driving operation of the third driving mode to rotate both the first rotor and the second rotator in response to the stopping of the first rotor.

16. The washing machine of claim 3, wherein the at least one processor is further configured to control the inverter circuit to start the driving operation of the third driving mode to rotate both the first rotor and the second rotator in response to the stopping of the second rotor.

17. A control method of a washing machine comprising a motor comprising a stator, a first rotor connected to a drum and a second rotor connected to a pulsator, and an inverter circuit connected to the motor and comprising a first inverter configured to drive the first rotor and a second inverter configured to drive the second rotor, the control method comprising:

selectively driving the motor based on a plurality of driving modes to operate the washing machine, the plurality of driving modes including a first driving mode to rotate the first rotor only, a second driving mode to rotate the second rotor only, and a third driving mode to rotate both the first rotor and the second rotor;

stopping both the first rotor and the second rotor in response to changing from one of the plurality of driving modes to an other one of the plurality of driving mode; and controlling the inverter circuit to perform a driving operation of the changed mode by driving the motor in the changed mode, wherein the driving operation comprises an alignment operation to align the first rotor and the second rotor to a predetermined angle, and wherein the control method further comprises performing the alignment operation by performing a pulse width modulation (PWM) control on the first inverter and the second inverter simultaneously in the first driving mode or in the second driving mode.

18. The control method of claim 17, wherein the stopping of both the first rotor and the second rotor include stopping the first rotor or the second rotor in response to the changing of the driving mode of the motor from the first driving mode or the second driving mode to the third driving mode.

19. The control method of claim 17, wherein the stopping of both the first rotor and the second rotor include stopping both the first rotor and the second rotor in response to the driving mode of the motor being changed from the third driving mode to the first driving mode or the second driving mode.

20. The control method of claim 17, further comprising rotating one or more of the first rotor and the second rotor in response to the stopping of both the first rotor and the second rotor.

* * * * *